US012024985B2

(12) United States Patent
Al-Mousa et al.

(10) Patent No.: US 12,024,985 B2
(45) Date of Patent: Jul. 2, 2024

(54) SELECTIVE INFLOW CONTROL DEVICE, SYSTEM, AND METHOD

(71) Applicant: Saudi Arabian Oil Company, Dhahran (SA)

(72) Inventors: Ahmed Al-Mousa, Doha (SA); Marius Neacsu, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 126 days.

(21) Appl. No.: 17/656,331

(22) Filed: Mar. 24, 2022

(65) Prior Publication Data

US 2023/0304385 A1 Sep. 28, 2023

(51) Int. Cl.

| | |
|---|---|
| ***E21B 43/08*** | (2006.01) |
| ***E21B 34/14*** | (2006.01) |
| ***E21B 43/14*** | (2006.01) |

(52) U.S. Cl.

CPC ..... *E21B 43/08* (2013.01); *E21B 34/14* (2013.01); *E21B 43/14* (2013.01); *E21B 2200/06* (2020.05)

(58) Field of Classification Search

CPC ..... E21B 43/08; E21B 43/12; E21B 43/14; E21B 43/10; E21B 23/00; E21B 34/14; E21B 34/142; E21B 2200/02; E21B 2200/06

See application file for complete search history.

(56) References Cited

U.S. PATENT DOCUMENTS

| | | | |
|---|---|---|---|
| 1,843,217 | A | 2/1932 | Fletcher |
| 2,874,781 | A | 2/1959 | McGaffey |
| 3,104,549 | A | 9/1963 | Humbert et al. |
| 3,316,767 | A | 5/1967 | Liebert |
| 3,373,608 | A | 3/1968 | Ketelsen |

(Continued)

FOREIGN PATENT DOCUMENTS

| | | |
|---|---|---|
| CA | 2719792 | 6/2015 |
| CA | 2802988 | 10/2015 |

(Continued)

OTHER PUBLICATIONS

U.S. Appl. No. 17/728,184, filed Apr. 25, 2022, Al-Yousef et al.

(Continued)

*Primary Examiner* — George S Gray
(74) *Attorney, Agent, or Firm* — Fish & Richardson P.C.

(57) ABSTRACT

A first interval inflow control device and a second interval inflow control device are positioned on a production tubing string proximate to a first subterranean interval and a second subterranean interval, respectively. The inflow control devices each include a central bore, a sand screen surrounding an inner tube, a plurality of ports connect the annular space between an inner surface of the sand screen and an outer surface of the inner tube, and a sliding sleeve configured to translate between an open position and closed position. A first shifting tool is configured to engage with and axially translate the sliding sleeve of the first interval inflow control device and a second shifting tool is configured to engage with and axially translate the sliding sleeve of the second interval inflow control device. The second shifting tool has an outer diameter less than the bore of the first interval inflow control device.

21 Claims, 11 Drawing Sheets

(56) References Cited

U.S. PATENT DOCUMENTS 4,051,723 A 10/1977 Head et al.
RE31,186 E 3/1983 Rosenweig
4,517,846 A 5/1985 Harrison et al.
4,676,313 A 6/1987 Rinaldi
4,757,314 A 7/1988 Aubin
4,777,833 A 10/1988 Carpenter
4,901,018 A 2/1990 Lew
4,965,996 A 9/1990 Morris
5,067,345 A 11/1991 Mougne
5,090,250 A 2/1992 Wada
5,139,089 A 8/1992 Wacker
5,164,897 A 11/1992 Clark
5,259,239 A 11/1993 Gaisford
5,392,648 A 2/1995 Robertson
5,417,118 A 5/1995 Lew et al.
5,586,310 A 12/1996 Sharman
5,854,991 A 12/1998 Gupta et al.
5,871,047 A 2/1999 Spath et al.
5,975,204 A 11/1999 Tubel et al.
6,006,831 A 12/1999 Schlemmer et al.
6,046,685 A 4/2000 Tubel
6,085,599 A 7/2000 Feller
6,106,032 A 8/2000 Och
6,163,257 A 12/2000 Tracy
6,237,424 B1 5/2001 Salmasi et al.
6,356,844 B2 3/2002 Thomas et al.
6,463,807 B1 10/2002 Feller
6,516,275 B2 2/2003 Lazaratos
6,549,879 B1 4/2003 Cullick et al.
6,626,048 B1 8/2003 Dam Es et al.
6,719,056 B2 4/2004 Hoffman et al.
6,747,372 B2 6/2004 Gilbreth et al.
6,882,904 B1 4/2005 Petrie et al.
6,920,799 B1 7/2005 Schulz
6,931,324 B2 8/2005 Taner et al.
6,950,825 B2 9/2005 Chang et al.
7,015,800 B2 3/2006 Lesesky et al.
7,088,639 B2 8/2006 Wells et al.
7,259,688 B2 8/2007 Hirsch et al.
7,265,544 B2 9/2007 Keese
7,376,517 B2 5/2008 Rickett
7,469,188 B2 12/2008 Wee
7,478,024 B2 1/2009 Gurpinar et al.
7,493,140 B2 2/2009 Michmerhuizen et al.
7,536,547 B2 5/2009 Van Den Tillaart
7,540,202 B2 6/2009 Bier
7,555,389 B2 6/2009 Cavalca et al.
7,557,701 B2 7/2009 Nunnazaki
7,574,907 B2 8/2009 Maute
7,584,165 B2 9/2009 Buchan
7,644,290 B2 1/2010 Ransom et al.
7,653,936 B2 1/2010 Oberst
7,739,359 B1 6/2010 Millet et al.
7,828,065 B2 11/2010 Ross
7,933,989 B1 4/2011 Barker et al.
7,937,222 B2 5/2011 Donadille et al.
7,940,302 B2 5/2011 Mehrotra et al.
8,039,991 B2 10/2011 Wakitani et al.
8,051,722 B2 11/2011 Voigt et al.
8,102,238 B2 1/2012 Golander et al.
8,195,590 B1 6/2012 Storek
8,271,212 B2 9/2012 Sai et al.
8,280,635 B2 10/2012 Ella et al.
8,312,320 B2 11/2012 Almadi
8,323,392 B2 12/2012 Jones et al.
8,334,775 B2 12/2012 Tapp et al.
8,359,171 B2 1/2013 Bleys et al.
8,365,250 B2 1/2013 Denny
8,365,612 B2 2/2013 Izumi
8,543,716 B1 9/2013 Rashidi
8,631,877 B2 1/2014 Gewily
8,667,091 B2 3/2014 Almadi
8,732,106 B1 5/2014 Presgraves et al.
8,746,337 B2 6/2014 Grigsby et al.
8,750,513 B2 6/2014 Renkis
8,757,273 B2 6/2014 Themig et al.
8,761,911 B1 6/2014 Chapman et al.
8,792,115 B2 7/2014 Harano
8,803,077 B2 8/2014 Schmidt
8,875,379 B2 11/2014 Maute
8,884,759 B2 11/2014 Oktem et al.
8,887,241 B2 11/2014 Britton et al.
8,972,742 B2 3/2015 Troncoso Pastoriza et al.
8,985,215 B2 3/2015 Tips et al.
8,991,505 B2 3/2015 Fleckenstein et al.
9,031,820 B2 5/2015 Frederick
9,147,174 B2 9/2015 Glickman et al.
9,208,676 B2 12/2015 Fadell et al.
9,210,179 B2 12/2015 Mevec et al.
9,396,599 B1 7/2016 Malhotra
9,467,472 B2 10/2016 Weiner et al.
9,506,325 B2 11/2016 Fould et al.
9,699,768 B2 7/2017 Werb
9,745,833 B2 8/2017 Carvajal et al.
9,760,075 B2 9/2017 Fisher-Rosemont
9,951,583 B2 4/2018 Gosselin et al.
10,125,586 B2 11/2018 Balan et al.
10,133,831 B2 11/2018 Carvajal et al.
10,330,511 B2 6/2019 Alkhabbaz et al.
10,462,884 B2 10/2019 Jayawardena et al.
10,514,415 B2 12/2019 Jayawardena et al.
10,551,047 B2 2/2020 Treible, Jr. et al.
10,563,483 B2 2/2020 Steele
10,570,716 B2 2/2020 Balan et al.
10,590,741 B2 3/2020 Van Der Veen
10,677,034 B2 6/2020 Balan et al.
10,677,035 B2 6/2020 Balan et al.
11,341,830 B2 5/2022 Al-Yousef et al.
2002/0152053 A1 10/2002 Roy et al.
2003/0117298 A1 6/2003 Seely
2004/0035578 A1* 2/2004 Ross ..... E21B 43/08 166/321
2004/0045368 A1 3/2004 Schoeb
2004/0098592 A1 5/2004 Taki
2004/0188710 A1 9/2004 Koren et al.
2005/0015624 A1 1/2005 Ginter et al.
2005/0184084 A1 8/2005 Wells
2005/0193832 A1 9/2005 Tombs et al.
2005/0228683 A1 10/2005 Saylor et al.
2006/0032547 A1 2/2006 Rossi
2006/0060352 A1* 3/2006 Vidrine ..... E21B 43/14 166/278
2006/0085174 A1 4/2006 Hemanthkumar
2006/0086497 A1 4/2006 Ohmer et al.
2006/0107061 A1 5/2006 Holovacs
2007/0016389 A1 1/2007 Ozgen et al.
2007/0018009 A1 1/2007 Choi et al.
2007/0126576 A1 6/2007 Script et al.
2007/0163359 A1 7/2007 Nielsen
2007/0193834 A1 8/2007 Pai
2007/0198223 A1 8/2007 Ella et al.
2007/0198234 A1 8/2007 Zangi et al.
2008/0061984 A1 3/2008 Breed et al.
2008/0109883 A1 5/2008 Hernoud et al.
2008/0109889 A1 5/2008 Bartels et al.
2008/0139195 A1 6/2008 Marsyla et al.
2008/0228908 A1 9/2008 Link
2008/0251260 A1 10/2008 Ross et al.
2008/0274766 A1 11/2008 Pratt et al.
2009/0012631 A1 1/2009 Fuller
2009/0037607 A1 2/2009 Farinacci et al.
2009/0089108 A1 4/2009 Angell et al.
2009/0138353 A1 5/2009 Mendelson
2009/0141896 A1 6/2009 McCown
2009/0164188 A1 6/2009 Habashy
2009/0210081 A1 8/2009 Sustaeta
2009/0224930 A1 9/2009 Burza
2009/0326826 A1 12/2009 Hull et al.
2010/0023269 A1 1/2010 Yusti et al.
2010/0097205 A1 4/2010 Script
2010/0097886 A1 4/2010 Day et al.
2010/0228584 A1 9/2010 Nash
2010/0231410 A1 9/2010 Seisenberger
2010/0292857 A1 11/2010 Bose et al.

(56) References Cited

U.S. PATENT DOCUMENTS

2010/0299125 A1 11/2010 Ding et al.
2011/0042083 A1 2/2011 Sierra et al.
2011/0066454 A1 3/2011 Rosauer et al.
2011/0071963 A1 3/2011 Piovesan et al.
2011/0074551 A1 3/2011 Higashionji
2011/0136463 A1 6/2011 Ebdon
2011/0178977 A1 7/2011 Drees
2011/0181426 A1 7/2011 Bucciero et al.
2011/0288692 A1 11/2011 Scott
2011/0296377 A1 12/2011 Morozov et al.
2012/0016649 A1 1/2012 Thambynayagam et al.
2012/0022700 A1 1/2012 Drees et al.
2012/0059634 A1 3/2012 Bouzarkouna
2012/0060030 A1 3/2012 Lamb
2012/0063354 A1 3/2012 Vanga et al.
2012/0084400 A1 4/2012 Almadi et al.
2012/0162423 A1 6/2012 Xiao
2012/0172085 A1 7/2012 Vuppu
2012/0307051 A1 12/2012 Welter
2013/0035920 A1 2/2013 Al-Shammari
2013/0085687 A1 4/2013 Danov et al.
2013/0086650 A1 4/2013 Soundrapandian et al.
2013/0088429 A1 4/2013 Yang
2013/0103749 A1 4/2013 Weth et al.
2013/0110411 A1 5/2013 Black et al.
2013/0136597 A1 5/2013 Hansen et al.
2013/0151020 A1 6/2013 Manninen et al.
2013/0162405 A1 6/2013 Forster
2013/0212259 A1 8/2013 Rankov et al.
2013/0247117 A1 9/2013 Yamada
2013/0282641 A1 10/2013 Martin et al.
2013/0319687 A1* 12/2013 Huh ..... E21B 34/14 166/117.6
2014/0019768 A1 1/2014 Pineau et al.
2014/0046863 A1 2/2014 Gifford et al.
2014/0083766 A1* 3/2014 Tips ..... E21B 44/00 175/24
2014/0089671 A1 3/2014 Logue
2014/0118239 A1 5/2014 Phillips
2014/0139681 A1 5/2014 Jones, Jr. et al.
2014/0150549 A1 6/2014 Rieger et al.
2014/0156584 A1 6/2014 Motukuri et al.
2014/0170025 A1 6/2014 Weiner et al.
2014/0180658 A1 6/2014 Rossi
2014/0230057 A1 8/2014 Berger
2014/0240088 A1 8/2014 Robinette
2014/0251627 A1* 9/2014 Holderman ..... E21B 43/12 166/316
2014/0254799 A1 9/2014 Husted
2014/0261791 A1 9/2014 Grabau et al.
2014/0280953 A1 9/2014 Brzozowski et al.
2014/0310059 A1 10/2014 Ellis
2014/0337086 A1 11/2014 Asenjo et al.
2014/0340222 A1 11/2014 Thornton
2014/0342373 A1 11/2014 Viovy et al.
2014/0345876 A1* 11/2014 Coon ..... E21B 34/14 166/373
2015/0074023 A1 3/2015 Gu
2015/0075800 A1* 3/2015 Allen ..... E21B 34/14 166/320
2015/0109104 A1 4/2015 Fadell
2015/0116111 A1 4/2015 Foster
2015/0137967 A1 5/2015 Wedig
2015/0152035 A1 6/2015 Shin et al.
2015/0168573 A1 6/2015 Zhang et al.
2015/0195789 A1 7/2015 Yoon
2015/0218916 A1* 8/2015 Richards ..... E21B 34/14 166/278
2015/0220321 A1 8/2015 Jung
2015/0370934 A1 12/2015 Pride et al.
2016/0006745 A1 1/2016 Furuichi
2016/0091623 A1 3/2016 Yu et al.
2016/0100437 A1 4/2016 Amstrong et al.
2016/0123111 A1 5/2016 Kim
2016/0153263 A1 6/2016 Jannise et al.
2016/0178772 A1 6/2016 Carter
2016/0206136 A1 7/2016 Storek
2016/0234239 A1 8/2016 Knapp et al.
2016/0259637 A1 9/2016 Kumar
2016/0259647 A1 9/2016 Kim et al.
2016/0282881 A1 9/2016 Filippov
2016/0305217 A1 10/2016 Patel
2016/0379211 A1 12/2016 Hoyos
2017/0031840 A1 2/2017 Cawse et al.
2017/0034193 A1 2/2017 Schulman et al.
2017/0053224 A1 2/2017 Duca et al.
2017/0061715 A1 3/2017 Busch-Sorensen
2017/0114619 A1 4/2017 Conn et al.
2017/0184659 A1 6/2017 Jayawardena et al.
2017/0284191 A1 10/2017 Martin
2017/0289812 A1 10/2017 Werb
2017/0321547 A1 11/2017 Enkababian et al.
2017/0353491 A1 12/2017 Gukal
2017/0356780 A1 12/2017 Smith et al.
2018/0092331 A1 4/2018 Zuidhof
2018/0156437 A1 6/2018 Freer et al.
2018/0171761 A1 6/2018 Schneider et al.
2018/0188403 A1 7/2018 Halsey et al.
2018/0230780 A1 8/2018 Klenner
2019/0149894 A1 5/2019 Weatherhead et al.
2019/0159322 A1 5/2019 Jayawardena et al.
2019/0234603 A1 8/2019 Treible, Jr. et al.
2019/0295207 A1 9/2019 Day
2019/0318170 A1 10/2019 Rokade et al.
2019/0340909 A1 11/2019 Nguyen et al.
2020/0199984 A1 6/2020 Wright et al.
2021/0014308 A1 1/2021 Larsson
2021/0084436 A1 3/2021 Sutherland
2022/0044538 A1 2/2022 Al-Yousef et al.
2022/0298897 A1 9/2022 Al Sulaiman et al.
2023/0287783 A1 9/2023 Al Madan

FOREIGN PATENT DOCUMENTS

CA 2856274 3/2016
CA 2899222 1/2017
CN 102520388 6/2012
CN 102754105 10/2012
CN 203322437 12/2013
CN 103842615 6/2014
CN 105493100 4/2016
CN 105706089 6/2016
EP 0770856 9/2003
EP 1612741 1/2006
EP 1832548 12/2007
EP 2396273 12/2011
EP 2951720 12/2015
EP 3135858 3/2017
EP 3196716 7/2017
FR 2950993 4/2011
GB 1493527 11/1977
GB 2580470 7/2020
JP H 07152789 6/1995
JP 2014119266 6/2014
WO WO 2006059057 6/2006
WO WO 2009000283 12/2008
WO WO 2013044300 4/2013
WO WO 2013130551 9/2013
WO WO 2014144917 9/2014
WO WO 2014168617 10/2014
WO WO 2015016932 2/2015
WO WO 2015058134 4/2015
WO WO 2015167935 11/2015
WO WO 2016010813 1/2016
WO WO 2016073267 5/2016
WO WO 2016097998 6/2016
WO WO 2016186627 11/2016
WO WO 2017040457 3/2017
WO WO 2017074883 5/2017
WO WO 2017111964 6/2017
WO WO 2017151838 9/2017
WO WO 2017165949 10/2017
WO WO 2018045255 3/2018

(56) References Cited

FOREIGN PATENT DOCUMENTS

| | | |
|---|---|---|
| WO | WO 2018111103 | 6/2018 |
| WO | WO 2018132786 | 7/2018 |
| WO | WO 2018207123 | 11/2018 |
| WO | WO 2019099038 | 5/2019 |
| WO | WO 2019211764 | 11/2019 |

OTHER PUBLICATIONS

"IsoRite Isolated Multilateral Completion Systems: For Multilateral Wells that Require Re-Entry Capability to Access the Lateral," Halliburton, Completion Solutions, Multilateral Systems, 2018, 3 pages.
"SLIC: Selective Lateral Intervention Completion System," Schlumberger, 2019, 2 pages.
Abdel-Basset et al., "Chemical and Mechanical Water Shut-Off in Horizontal Passive ICD Wells; Experience and Lessons Learnt in Giant Darcy Reservoir," IPTC-20210-MS, International Petroleum Technology Conference (IPTC), presented at the International Petroleum Technology Conference, Dhahran, Saudi Arabia, Jan. 13-15, 2020, 29 pages.
Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers (SPE), presented at the Abu Dhabi International Petroleum Exhibition & Conference, Abu Dhabi, UAE, Nov. 7-10, 2016, 14 pages.
Ali et al., "Constraining Interwell Water Flood Imaging with Geology and Petrophysics: An Example from the Middle East," Paper presented at the 2009 SPE Middle East Oil & Gas Show and Conference, Bahrain, Mar. 15-18, 2009, SPE 120558, 11 pages.
Al-Khaldy et al., "First-Ever Level 4 Multilateral Well in North Kuwait Successfully Completed, Improves Oil Production," SPE-171792-MS, Society of Petroleum Engineers (SPE), presented at the Abu Dhabi International Petroleum Exhibition and Conference, Abu Dhabi, UAE, Nov. 10-13, 2014, 12 pages.
Alkhatib et al., "Robust Quantification of Uncertainty in Heterogeneity for Chemical EOR Processes: Applying the Multi-Level Monte Carlo Method," Paper presented at the SPE Middle East Oil & Gas Show and Conference, Bahrain, Mar. 8-11, 2015, 21 pages.
Almadi, "Intelligent Field Infrastructure Adoption: Approach and Best Practices," SPE 150066, Society of Petroleum Engineers (SPE), presented at the SPE intelligent Energy International Conference, Mar. 27-29, 2012, 12 pages.
Arukhe et al., "Technology Evolution in a Giant Saudi Aramco's Field Development," WPC-21-0182, Work Petroleum Congress (WPC), presented at the 21st World Petroleum Congress, Moscow, Russia, Jun. 2014, 17 pages.
Boman, "IoT Technology to Reduce Need for Oil, Gas Workers Offshore," Oct. 14, 2016, rigzone.com (online), retrieved from URL <https://www.rigzone.com/news/oil_gas/a/147044/iot_technology_to_reduce_need_for_oil_gas_workers_offshore/>, 5 pages.
Canaz, "Planar and Linear Feature-Based Registration of Terrestrial Laser Scans with Minimum Overlap Using Photogrammetric Data," Masters Thesis, University of Calgary, Dec. 2012, 142 pages.
Cohen, "Reducing Business Surprises through Proactive, Real-Time Sensing and Alert Management," EESR Workshop on End-to-End, Sense-and Respond Systems, Applications and Services, 2005, 6 pages.
Ertekin et al., "Artificial Intelligence Applications in Reservoir Engineering: A Status Check," Energies, Jul. 2019, XP055776157, 12(15): 2897, 22 pages.
Falcone et al., "Model Predicts More Accurate PI Over a Field's Life," Oil and Gas Journal, Pennwell Houston, Texas, vol. 99, No. 12, Mar. 19, 2001, 5 pages.
Giles, "Multilevel Monte Carlo path simulation," Operations Research, 56(3), May-Jun. 2008, 607-617, 12 pages.
Gokce et al., "Vision-Based Detection and Distance Estimation of Micro Unmanned Aerial Vehicles," Sensors, 2015, 15:23805-23846, 42 pages.
Hale, "Evaluating safety management and culture interventions to improve safety: Effective intervention strategies," Safety Science, Oct. 2010, 48:8 (1026-1035), 10 pages.
Halliburton [online], "Digital Twin Implementation for Integrated Production & Reservoir Management," iEnergy, 2018, retrieved on Sep. 27, 2019, retrieved from URL: <https://www.ienergy.community/Portals/1/IenergyDocs/Marketing/DigitalTwin_Integrated_Reservoir_Production.pdf>, 17 pages.
Huia et al., "Prediction of Safety Objective of an Enterprise using Fuzzy Neural Network," International Symposium on Safety Science and Engineering in China, Procedia Engineering, 43: 162-167, 2012, 6 pages.
Husain et al., "Quantifying the Intelligent Field Added Values," SPE 167439, Society of Petroleum Engineers (SPE), presented at the SPE Middle East Intelligent Energy Conference and Exhibition, Oct. 28-30, 2013, 9 pages.
Li et al., "A Comparative Study of the Probabilistic-Collocation and Experimental-Design Methods for Petroleum-Reservoir Uncertainty Quantification," SPE Journal, vol. 16, No. 2, Jun. 2011; pp. 429-439, 11 pages.
Liang et al., "Crosswell Electromagnetic Inversion Constrained by the Fluid-Flow Simulator," Paper presented at the SPE Annual Technical Conference and Exhibition, Florence, Italy, Sep. 19-22, 2010; 11 pages.
Marsala et al., "3D inversion practice for crosswell electromagnetic surveys in horizontal wells in Saudi Arabia," 85th Annual International Meeting, SEG, 2015; 4 pages.
Marsala et al., "Crosswell electromagnetic induction between two widely spaced horizontal wells: Coiled-tubing conveyed data collection and 3D inversion from a carbonate reservoir in Saudi Arabia," 85th Annual International Meeting, SEG, 2015; 4 pages.
Marsala et al., "Crosswell Electromagnetic Tomography: from Resistivity Mapping to Interwell Fluid Distribution," Paper presented at the International Petroleum Technology Conference in Kuala Lumpur (IPTC 12229), 2008; 6 pages.
Marsala et al., "First Borehole to Surface Electromagnetic Survey in KSA: Reservoir Mapping and Monitoring at a New Scale," Paper presented at the SPE Annual Technical Conference and Exhibition (SPE-146348), Denver, Colorado, Oct. 30-Nov. 2, 2011, 9 pages.
Marsala et al., "Fluid Distribution Inter-Well Mapping in Multiple Reservoirs by Innovative Borehole to Surface Electromagnetic: Survey Design and Field Acquisition," Paper presented at the International Petroleum Technology Conference (IPTC-17045), Beijing, China, Mar. 26-28, 2013; 4 pages.
Memon et al., "Distributed control system for process control using intelligent agents," WSEAS Transactions on Systems, retrieved from URL <:https://www.researchgate.net/publication/270214069_Distributed_control_system_for_process_control_using_intelligent_agents>, retrieved on May 17, 2019, available on or before Mar. 1, 2006, 10 pages.
Mohaghegh, "Reservoir simulation and modeling based on artificial intelligence and data mining (AI&DM)," Journal of Natural Gas Science and Engineering, Aug. 2011, 3(6): 697-705, XP028125623, 9 pages.
offshore-technology.com (online), "Take Control: Smart Valves Step Forward," retrieved from URL <http://www.offshore-technology.com/features/feature2034/>, Jun. 18, 2008, 6 pages.
Petrie et al., "Chapter 1: Introduction to Laser Ranging, Profiling, and Scanning," Topographic Laser Ranging and Scanning: Principles and Processing, 2008, 29 pages.
Petrie et al., "Chapter 3: Terrestrial Laser Scanners," Topographic Laser Ranging and Scanning: Principles and Processing, 2009, 43 pages.
Putra et al., "Recovering Well Productivity in Banyu Urip Field," SPE Asia Pacific Oil & Gas Conference and Exhibition, Jakarta, Indonesia, Oct. 22-24, 2013, SPE 165793, Oct. 22, 2013, 8 pages.
pyimagesearch.com [online], Rosebrock, "Find distance from camera to object/marker using Python and OpenCV," Jan. 2015, retrieved

(56) References Cited

OTHER PUBLICATIONS on Oct. 21, 2020, retrieved from URL <https://www.pyimagesearch.com/2015/01/19/find-distance-camera-objectmarker-using-python-opencv/>, 109 pages.
Reneke et al., "Research Roadmap for Smart Fire Fighting NIST SP 1191," National Institute of Standards and Technology, Jun. 2015, 1-247.
Saeed et al., "Multilateral Reentry System for Well Surveillance: Design, Implementation and Summary of 40 Jobs Performed in Fields," SPE-199849-MS, Society of Petroleum Engineers (SPE), presented at the SPE/ICOTA Well Intervention Conference and Exhibition, The Woodlands, Texas, Mar. 24-25, 2020, 9 pages.
Saumya et al., "Saturation Forecast Using Machine Learning: Enabling Smarter Decision-Making Capabilities," SPE-197419-MS, Society of Petroleum Engineers, Nov. 2019, XP055796992, 10 pages.
Sawyer et al., "A simulation-based spreadsheet program for history matching and forecasting shale gas production" SPE 57439, Oct. 1999, 8 pages.
Siu et al., "Re-Engineering the Well Calibration Procedure for a Large Number of High Productivity Wells," SPE 66385, Proceedings of SPE Reservoir Simulation Symposium, Jan. 1, 2001, 14 pages.
slb.com [online], "Discovery MLT, Multilateral reentry system," available on or before Feb. 24, 2021, retrieved from URL <https://www.slb.com/well-intervention/coiled-tubing-intervention/mechanical-intervention/discovery-mlt-multilateral-reentry-system>, 3 pages.
Storey, "Building a Maintenance Management Program for Valves," Control Engineering, controleng.com (online), retrieved from URL <http://www.controleng.com/industry-news/single-article/building-a-maintenance-management-program-for-valves/20afd59f11c5dec4ec222cc79937e40b.html>, Apr. 17, 2014, 3 pages.
Sudakov et al., "Artificial Neural Network Surrogate Modeling of Oil Reservoir: A Case Study," Springer International Publishing, Cham, Advances in Neural Networks—ISNN 2019, Lecture Notes in Computer Science, Jun. 2019, 11555: 232-241.
Tatang et al., "An efficient method for parametric uncertainty analysis of numerical geophysical models," Journal of Geophysical Research, vol. 102, No. D18, Sep. 27, 1997; pp. 21,925-21,932.
Vaferi et al., "Hydrocarbon reservoir model detection from pressure transient data using coupled artificial neural network-Wavelet transform approach," Applied Soft Computing, Elsevier, Amsterdam, NL, Jun. 2016, XP029661645, 47: 63-75, 13 pages.
Wilt et al., "Monitoring a Water Flood of Moderate Saturation Changes with Crosswell Electromagnetics (EM): A Case Study from Dom Joao Brazil," Paper presented at the SEG Las Vegas 2012 Annual Meeting, 2012; 4 pages.
Xindi et al., "Comprehensive Review of Water Shutoff Methods for Horizontal Wells," Petroleum Exploration and Development, Dec. 2017, 44:6 (1022-1029), 8 pages.
PCT International Search Report and Written Opinion in International Appln.. No. PCT/US2023/015931, dated May 10, 2023, 15 pages.

* cited by examiner

SELECTIVE INFLOW CONTROL DEVICE, SYSTEM, AND METHOD

TECHNICAL FIELD

This disclosure relates to the production of oil, gas, or other resources from subterranean zones to the surface.

BACKGROUND

Hydrocarbons or other resources in subsurface reservoirs or locations below the Earth's surface can be produced to the surface via wells drilled from the surface to the subsurface locations. After drilling, such wells are completed by installing one or more liners and production tubing to provide a pathway for such resources to flow to the surface. Liners can be cemented into the wellbore by introducing cement into the annular space between the wellbore and the liner or into the annular space between two successive liners. Liners can then be perforated at the downhole location or locations corresponding to the reservoirs or reservoir layers from which production is desired or expected. The produced liquids can flow to the surface via production tubing installed within the liner when completing the well.

To prevent or reduce the migration of sand or other particles from the reservoir to the production tubing, screens or other devices can be installed on the production tubing or on other suitable equipment or locations, as part of the well completion. Also as part of a well completion, inflow control devices or similar devices can be installed on the production tubing to control the flow of fluids into the production tubing. Such devices can be installed to equalizing reservoir inflow along the length of the production tubing, or for other purposes.

SUMMARY

Certain aspects of the subject matter herein can be implemented as a system for selectively controlling flow from different subterranean intervals into a production tubing string positioned within a casing in a wellbore. The system includes a first interval inflow control device configured to be positioned on the production tubing string proximate to a first set of perforations through the casing at a first subterranean interval and a second interval inflow control device configured to be positioned on the production tubing string proximate to a second set of perforations through the casing at a second subterranean interval. The first interval inflow control device and the second interval inflow control device each include a substantially cylindrical sand screen surrounding an inner tube, the inner tube having a central bore fluidically connected to and coaxial with a central bore of the production tubing string. An annular space is formed between an inner surface of the sand screen and an outer surface of the inner tube, and the annular space is fluidically connected to the central bore of the inner tube by a plurality of ports through the wall of the inner tube. A sliding sleeve is positioned within the inner bore and has a substantially cylindrical sleeve bore open to and coaxial with the central bore of the inner tube. The sliding sleeve is configured to translate axially from a first, open position in which the sliding sleeve does not prevent a flow of fluid through plurality of ports and a second, closed position in which the sliding sleeve prevents the flow of fluid through plurality of ports. The system also includes a first shifting tool configured to engage with and axially translate the sliding sleeve of the first interval inflow control device from the first, open position to the second, closed position, and a second shifting tool configured to engage with and axially translate the sliding sleeve of the second interval inflow control device from the first, open position to the second, closed position. The second shifting tool has an outer diameter less than an inner diameter of the sleeve bore of the sliding sleeve of the first interval inflow control device.

An aspect combinable with any of the other aspects can include the following features. The sliding sleeve of the first interval inflow control device can be locked in the first, open position by a shear pin.

An aspect combinable with any of the other aspects can include the following features. The system of claim 2, wherein the shear pin can be configured to be sheared by an application of force by the first shifting tool to the sliding sleeve of the first interval inflow control device.

An aspect combinable with any of the other aspects can include the following features. The sliding sleeve of the second interval inflow control device can be locked in the first, open position by a shear pin.

An aspect combinable with any of the other aspects can include the following features. The shear pin can be configured to be sheared by an application of force by the second shifting tool to the sliding sleeve of the second interval inflow control device.

An aspect combinable with any of the other aspects can include the following features. The sliding sleeve of the first interval inflow control device can further include a shifting profile configured to selectively engage with a corresponding shifting key of the first shifting tool.

An aspect combinable with any of the other aspects can include the following features. The sliding sleeve of the second interval inflow control device can further include a shifting profile configured to selectively engage with a corresponding shifting key of the second shifting tool.

An aspect combinable with any of the other aspects can include the following features. A tubing-casing annulus can be formed by an inner surface of the casing and an outer surface of the production tubing string. The system can also include a first packer positioned on the production tubing string uphole of the first interval inflow control device and configured to selectively isolate the tubing-casing annulus uphole of the first packer from tubing-casing annulus downhole of the upper packer, and a second packer positioned on the production tubing string between the first interval inflow control device and the second interval inflow control device and configured to selectively isolate the tubing-casing annulus below the first packer and above the second packer from the tubing-casing annulus below the second packer.

An aspect combinable with any of the other aspects can include the following features. The second shifting tool can be configured to pass through the first interval control device without engaging with the sliding sleeve of the first inflow control device.

An aspect combinable with any of the other aspects can include the following features. The system can be configured prior to positioning the production tubing string in the wellbore such that, when the production tubing string is positioned in the wellbore, the first interval inflow control device is proximate to the first set of perforations and the second interval inflow control device is proximate to the second set of perforations.

Certain aspects of the subject matter herein can be implemented as a method for selectively controlling flow from different subterranean intervals into a production tubing string positioned within a casing in a wellbore. The method includes passing a shifting tool in a downhole direction through a sliding sleeve of a first interval inflow control device positioned on the production tubing string proximate to a first set of perforations through the casing at a first subterranean interval to engage with a sliding sleeve of a second interval inflow control device positioned on the production tubing string proximate to a second set of perforations through the casing at a second subterranean interval. The first interval inflow control device and the second interval inflow control device each include a substantially cylindrical sand screen surrounding an inner tube, the inner tube having a central bore fluidically connected to and coaxial with a central bore of the production tubing string. An annular space is formed between an inner surface of the sand screen and an outer surface of the inner tube. The annular space is fluidically connected to the central bore of the inner tube by a plurality of ports through the wall of the inner tube, and the sliding sleeve of the first interval inflow control device and the sliding sleeve of the second interval inflow control device each have a substantially cylindrical sleeve bore open to and coaxial with the central bore of the respective inner tube. The method further includes engaging the shifting tool with the sliding sleeve of the second interval inflow control device an axially translating, by the shifting tool, the sliding sleeve of the second interval inflow control device from a first, open position in which the sliding sleeve does not prevent a flow of fluid through the plurality of ports of the second interval inflow control device to a second, closed position in which the sliding sleeve prevents the flow of fluid through the plurality of ports of the second interval inflow control device.

An aspect combinable with any of the other aspects can include the following features. Engaging the shifting tool with the sliding sleeve of the second interval inflow control device can include engaging a shifting key of the shifting tool with a shifting profile of the sliding sleeve of the second inflow control device.

An aspect combinable with any of the other aspects can include the following features. The method can further include shearing, by an application of force to the shifting tool, a shear pin locking the sliding sleeve of the second interval inflow control device in the first, open position by a shear pin.

An aspect combinable with any of the other aspects can include the following features. A tubing-casing annulus can be formed by an inner surface of the casing and an outer surface of the production tubing string. A first packer can be positioned on the production tubing string uphole of the first interval inflow control device which isolates the tubing-casing annulus uphole of the first packer from the tubing-casing annulus downhole of the upper packer. The method can further include actuating a second packer positioned on the production tubing string between the first interval inflow control device and the second interval inflow control device and thereby isolating the tubing-casing annulus below the first packer and above the second packer from the tubing-casing annulus below the second packer.

An aspect combinable with any of the other aspects can include the following features. The passing of the shifting tool in the downhole direction through the sliding sleeve of a first interval inflow control device can be a first instance of an interval isolation sequence and wherein the shifting tool is a second shifting tool. The method can further include a second instance of the interval isolation sequence. The second instance of the interval isolation sequence method can include lowering a first shifting tool in a downhole direction to the sliding sleeve of the first interval inflow control device, engaging the first shifting tool with the sliding sleeve of the first interval inflow control device, and axially translating, by the first shifting tool, the sliding sleeve of the first interval inflow control device from a first, open position in which the sliding sleeve does not prevent a flow of fluid through the plurality of ports of the first interval inflow control device to a second, closed position in which the sliding sleeve prevents the flow of fluid through the plurality of ports of the first interval inflow control device.

An aspect combinable with any of the other aspects can include the following features. Engaging the first shifting tool with the sliding sleeve of the first interval inflow control device can include engaging a shifting key of the first shifting tool with a shifting profile of the sliding sleeve of the first inflow control device.

An aspect combinable with any of the other aspects can include the following features. A tubing-casing annulus is formed by an inner surface of the casing and an outer surface of the production tubing string and a first packer positioned on the production tubing string uphole of the first interval inflow control device can isolate the tubing-casing annulus uphole of the first packer from the tubing-casing annulus downhole of the upper packer. The method can further include actuating a second packer positioned on the production tubing string between the first interval inflow control device and the second interval inflow control device, thereby isolating the tubing-casing annulus below the first packer and above the second packer from the tubing-casing annulus below the second packer.

An aspect combinable with any of the other aspects can include the following features. The second shifting tool can be configured to pass through the first interval control device without engaging with the sliding sleeve of the first inflow control device.

An aspect combinable with any of the other aspects can include the following features. The method can further include, prior to positioning the production tubing string in the wellbore, configuring the production tubing string such that, when the production tubing string is positioned in the wellbore, the first interval inflow control device is proximate to the first set of perforations and the second interval inflow control device is proximate to the second set of perforations.

An aspect combinable with any of the other aspects can include the following features. Actuating the sliding sleeve can be in response to an indication that an amount of water relative to an amount of oil or gas produced from the second subterranean interval has increased.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

In accordance with embodiments of the present invention, inflow from different subterranean intervals into a production tubing string of a wellbore can be selectively controlled. In this way, one or more of the subterranean intervals can be selectively isolated and unwanted fluid flow from those subterranean intervals can be selectively reduced or eliminated. In certain circumstances, for example, one or more intervals may begin to produce a higher water content relative to the amount of oil or gas produced, making it desirable to partially or fully shut off fluid flow into the production string from such intervals, temporarily or permanently.

In accordance with some embodiments of the present disclosure, an improved method and system for controlling flow from specific intervals is disclosed. The system and method enable such control to be performed with respect to screened inflow control devices at different levels, simply and economically, thus reducing costly rig time and reducing or avoiding the need to run patches or isolation plugs, or to recomplete the well.

Figure 1:
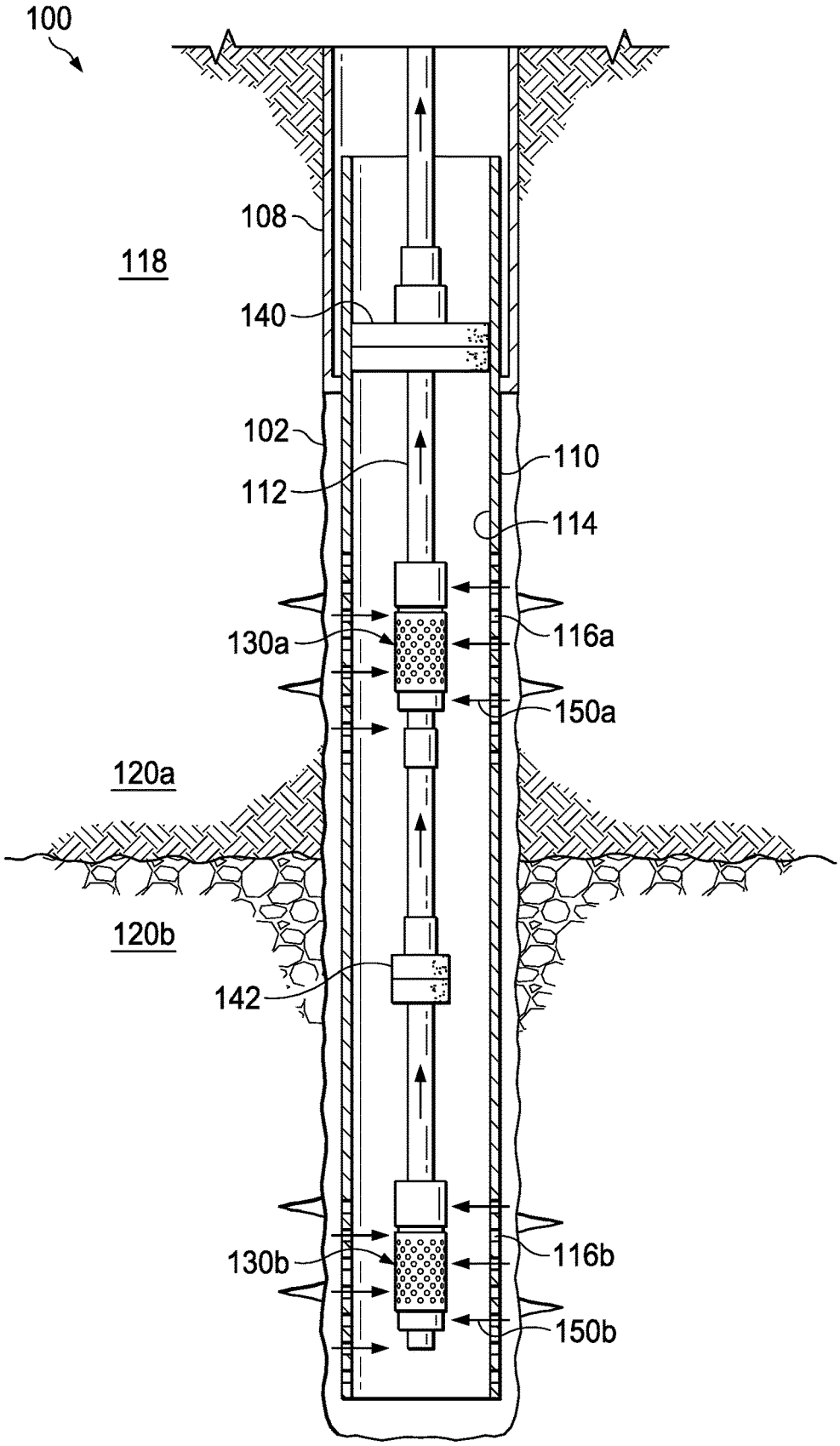
FIG. 1 is a schematic illustration of well system in accordance with an embodiment of the present disclosure.

FIG. 1 is a schematic illustration of well system 100 in accordance with an embodiment of the present disclosure. Referring to FIG. 1, well system 100 that includes a substantially cylindrical wellbore 102 extending into the Earth into a subterranean zone 118. In the embodiment shown in FIG. 1, wellbore 102 is drilled through two discrete intervals of subterranean zone 118: first interval 120*a* and second interval 120*b*. Second interval 120*b* in the illustrated embodiment is downhole in wellbore 102 relative to first interval 120*a*. First interval 120*a* and second interval 120*b* can be, for example, different geological formations or different stratigraphic layers within a formation or different hydrocarbon production zones other discrete or otherwise different zones of interest. While FIG. 1 shows two such intervals, well system 100 can include more than two intervals. The intervals and the boundary between them can be substantially horizontal (as shown in FIG. 1) or other than substantially horizontal (for example, closer to vertical than horizontal). Likewise, while wellbore 102 is shown as extending substantially vertically from the surface through first interval 120*a* and second interval 120*b*, the concepts described here can be applicable to many different configurations of wells, including vertical, horizontal, slanted, or wells that are otherwise non-horizontal, partially or fully, with respect to the surface and/or with respect to the intervals.

After some or all of the wellbore 102 is drilled, a portion of the wellbore 102 extending into first interval 120*a* and second interval 120*b* can be lined with lengths of tubing, called casing or liner. The wellbore 102 can be drilled in stages, the liners can be installed between stages, and cementing operations can be performed to inject cement in stages in the annulus between the liner and inner surface of the wellbore (and/or the annulus between the inner surface of an outer, larger-diameter liner into which the (smaller-diameter) liner has been positioned.

In some embodiments of the present disclosure, a well system (such as well system 100) can be constructed by lowering a first liner into place and then cementing the annulus by injecting a cement slurry downhole through central bore of the liner, such that the cement slurry then travels uphole within the annulus and hardens. After installation and cementing of the first liner, the second, smaller-diameter liner can be lowered within the first liner and the second liner cemented into place. Subsequent liners can likewise be installed in progressively lower sections. Accordingly, in the example well system 100 of FIG. 1, the system 100 includes a first, outer liner 108, defined by lengths of tubing lining an upper portion of the wellbore 102 extending from the surface into the Earth. Outer liner 108 is shown as extending only partially down the wellbore 102. The example well system 100 also includes a second, inner liner 110 positioned radially inward from the outer liner 108 and defined by lengths of tubing that line a lower portion of the wellbore 102 that extends further downhole of the wellbore 102 than the portion of the wellbore into which first liner 108 has been positioned.

After installation of the casing or liner, production tubing string 112 can be installed in wellbore 102 within the liners. Production tubing string 112 can comprise lengths of tubing connected to each other and acts as the primary conduit through which fluids are produced to the surface. The outer surface of production tubing string 112 and the inner surface of the liners forms an annulus 114. In the illustrated embodiment, perforations 116*a* through liner 110 allow hydrocarbons or other fluids to enter wellbore 102 from first interval 120*a*, and perforations 116*b* allow hydrocarbons or other fluids to enter wellbore 102 from second interval 120*b*. In some embodiments, liner 110 (and/or other liners uphole or downhole of liner 110) can include additional or other perforations corresponding to intervals 120*a* or 120*b* or to different or additional subterranean intervals.

In the illustrated embodiment, inflow control devices (ICDs) 130*a* and 130*b* are installed on production tubing string 112 and provide a pathway for the fluids entering the wellbore via perforations 116*a* and 116*b* to enter production tubing string 112. In the illustrated embodiment, first interval ICD 130*a* is installed at a location on the tubing string proximate to perforations 116*a*, and thus is proximate to the flow of fluid 150*a* from first interval 120*a*. Second interval ICD 116*b* is installed at a location on the tubing string proximate to perforations 116*b*, and the is proximate to the flow of fluid 150*b* from second interval 120*b*. ICDs 130*a* and 130*b* are described in more detail in reference to FIGS. 2A and 2B. In some embodiments, the well system can include a greater number of ICDs for one or more single intervals and/or additional ICDs corresponding to additional subterranean zones, or more than one ICD per interval.

In the illustrated embodiment, packer 140 is installed on production tubing 112 and when activated, can seal and isolate the annulus 114 above packer 140 from annulus 114 below packer 140. Packer 142 is positioned between first interval ICD 130*a* and second interval ICD 130*b* and, when activated, isolate annulus 114 below packer 140 and above packer 142 from annulus 114 below packer 142. In some embodiments, packers 140 and 142 can be mechanical set packers. In some embodiments, packers 140 and/or 142 can be swellable packers or another suitable packer type. In some embodiments, instead of two packers, three or more packers can be installed on production tubing 112 to, for example, isolate the annulus above and below additional ICDs corresponding to additional subterranean intervals.

In accordance with some embodiments of the present invention, ICDs 130*a* and 130*b* can be selectively opened and closed, and packers 140 and 142 selectively activated, to selectively permit fluid flow into production tubing 112 from first interval 120*a*, or from second interval 120*b*, or from both intervals. Additional ICDs of similar design and configuration as ICDs 130*a* and 130*b* and additional packers can in some embodiments be installed on other portions of production tubing 112 to likewise selectively permit fluid flow from all or some of the plurality (for example, three or four or more) subterranean intervals.

Figure 2A:
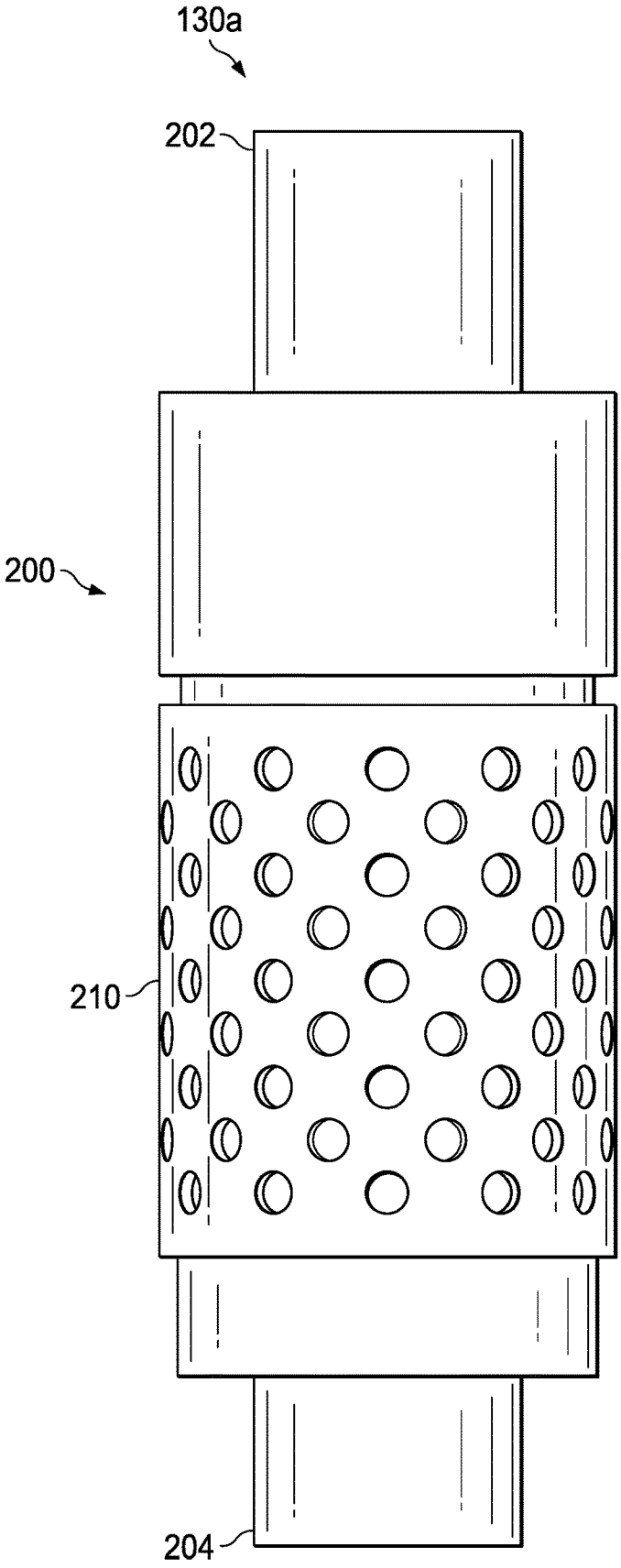
FIGS. 2A and 2B are schematic illustrations of an inflow control device in accordance with certain embodiments of the present disclosure.
Figure 2B:
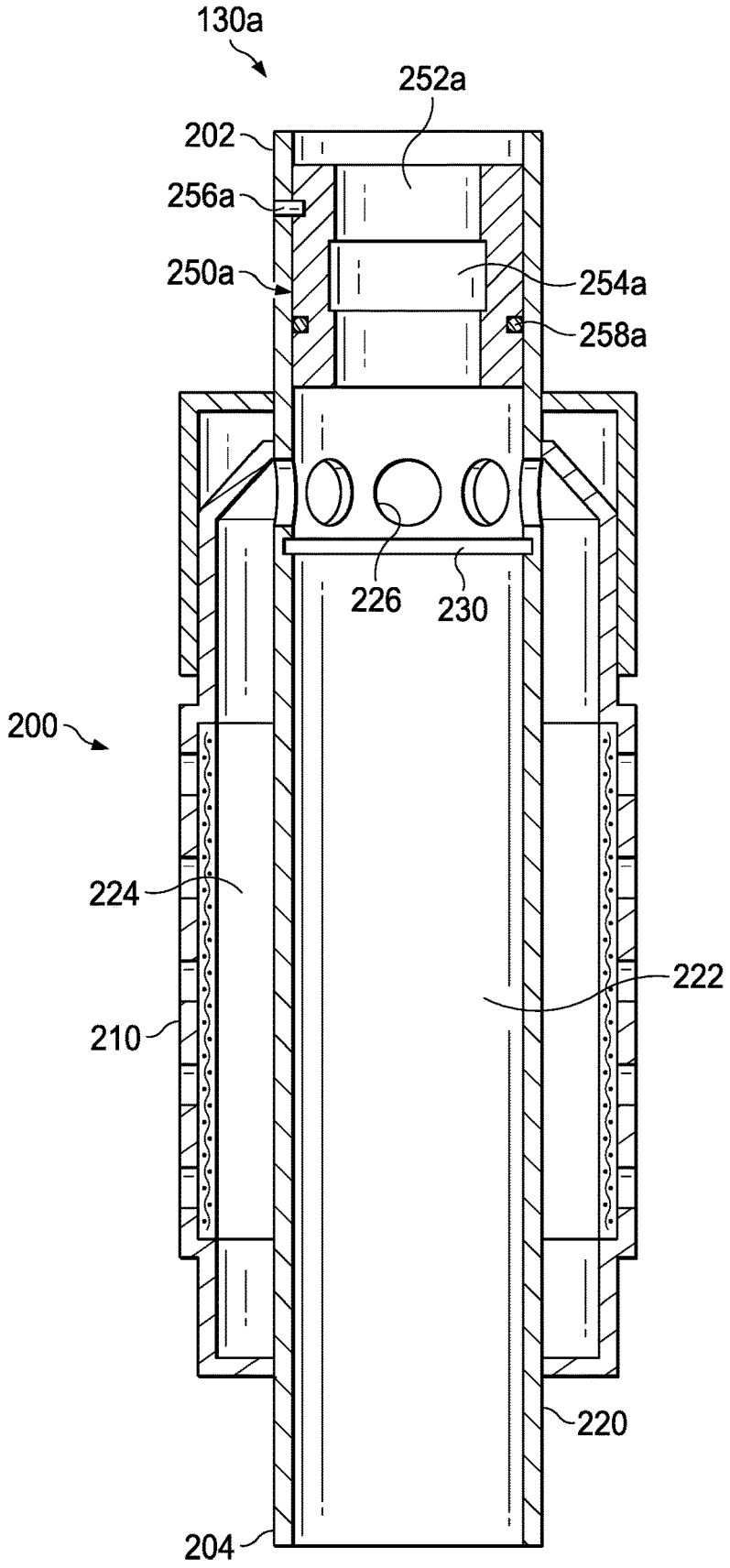

FIGS. 2A and 2B are schematic illustrations an ICD in accordance with certain embodiments of the present disclosure. Specifically, FIG. 2A is an external schematic of first interval ICD 130*a* of FIG. 1, and FIG. 2B shows in internal cross-section of first interval ICD 130*a*. First interval ICD 130*a* comprises a main body 200, and can be connected to production tubing at an upper end 202 and a lower end 204. Screen 210 wraps circumferentially around ICD 130 and allows fluid flow into first interval ICD 130*a* while filtering out sand and other particulate matter. Within main body 200 is substantially cylindrical inner tube 220 having a central bore 222 which is open to and aligns axially with the central bore of the production tubing. The inner surface of screen 210 and the outer surface of inner tube 220 forms an annular space 224, and fluid entering through screen 210 can flow through the annular space and into central bore 222 via ports 226.

First interval ICD 130*a* further includes a sliding sleeve 250*a* which has a sleeve inner bore 252 open to and axially aligned with central bore 222. Sleeve 250*a* is configured to be translated axially (for example, by a shifting tool) from a first position in which ports 226 are not blocked by sleeve 250*a* to a second position in which ports 226 are blocked by sleeve 250*a*. Accordingly, in the first position, fluid can flow from annulus 224 to central bore 222, whereas in the second position, fluid cannot flow from annulus 224 to central bore 222. In the illustrated embodiment, sliding sleeve 250*a* further includes a shifting profile 254*a* which can selectively engage with a corresponding shifting key of a shifting tool (for example, a shifting tool shown in FIG. 3A), thus locking sleeve 250*a* with the shifting tool such that sleeve 250*a* is axially translated by axial translation of the shifting tool.

First interval ICD 130*a* further includes a shear pin 256*a* which locks sleeve 250*a* in the first position until the pin is sheared, for example, by the shifting tool applying sufficient force to shear the pin. In the illustrated embodiment, sleeve 250*a* further includes a locking ring 258*a* which can lock sleeve 250*a* in the second position by latching into recess 230 which extends circumferentially about the inner surface of inner tube 220. In other embodiments, other types of keys, locking profiles, other mechanisms can be used to lock or hold sleeve 250*a* in the first or second position or in other desired axial positions.

Second interval ICD 130*b* of FIG. 1 can in some embodiments have the same or substantially the same elements, design and configuration as first interval ICD 130*a* as shown in FIGS. 2A and 2B. However, described in further detail in reference to FIGS. 3A and 3B, in some embodiments, an inner bore diameter of the sliding sleeve of second interval ICD 130*b* can have a different (for example, smaller) diameter than inner bore 252A of sliding sleeve 250*a* of first interval ICD 130*a*.

Figure 3A:
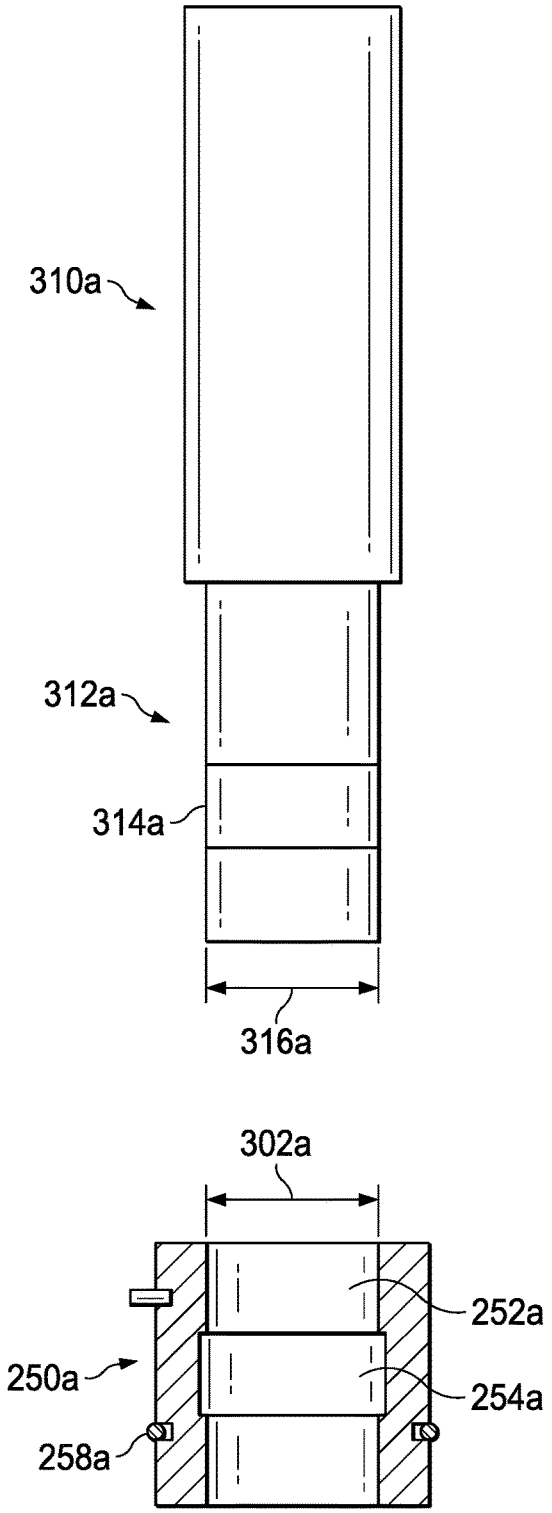
FIGS. 3A and 3B are schematic illustration of shifting tool and sliding sleeve pairs in accordance with certain embodiments of the present disclosure.
Figure 3B:
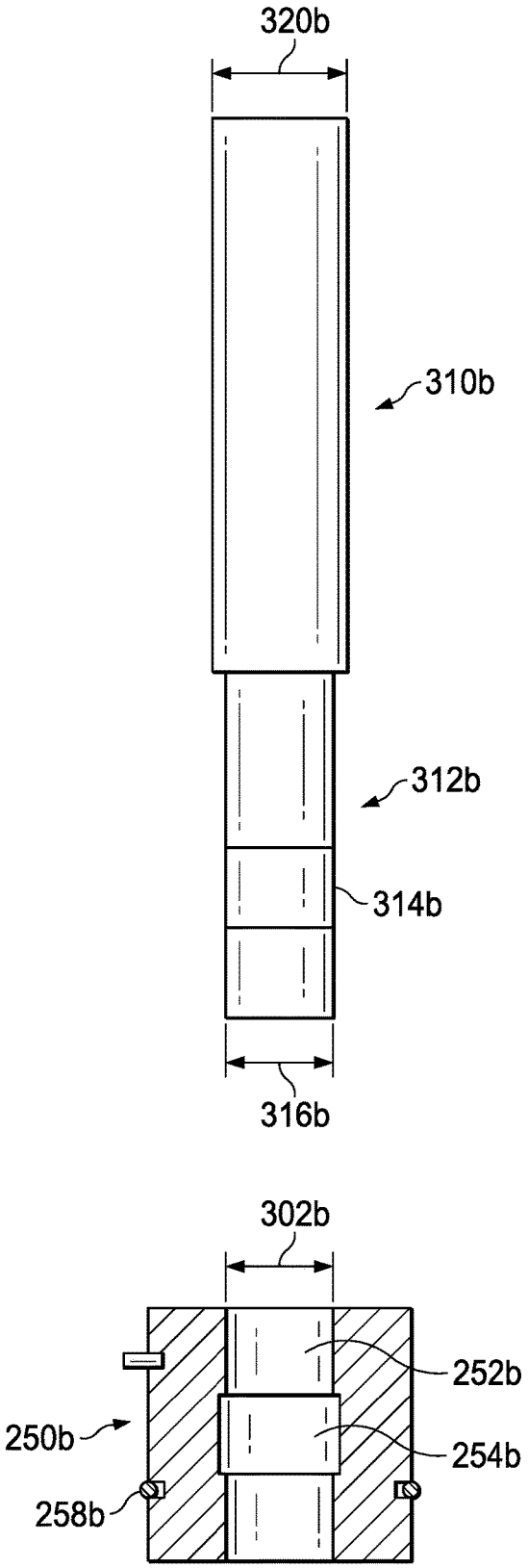

FIGS. 3A and 3B are schematic illustration of shifting tool and sliding sleeve pairs in accordance with certain embodiments of the present disclosure. Sliding sleeve 250*a* of FIG. 3A corresponds to sliding sleeve 250*a* of first interval ICD 130*a* of FIG. 1. Sliding sleeve 250*b* of FIG. 3B corresponds to a sliding sleeve which, in some embodiments, is positioned within second interval ICD 130*b* (in place of or instead of sliding sleeve 250*a*).

Referring to FIG. 3A, first interval shifting tool 310*a* has a lower locking section 312*a* having an external diameter 316*a* that is the same or less than the diameter 302A of inner bore 252A of sliding sleeve 250*a*. First interval shifting tool 310*a* further includes a shifting key 314*a* which corresponds to shifting profile 254*a* of sleeve 250*a*. Shifting key 314*a* can selectively engage and lock with shifting profile 254*a* such that sleeve 250*a* can be axially translated by axial translation of first interval shifting tool 310*a*.

Referring to FIG. 3B, sliding sleeve 250*b* is substantially similar to sliding sleeve 250*a* except that inner bore 252*b* of sliding sleeve 250*b* has a smaller diameter 302*b* than inner bore 252A of sliding sleeve 250*a*. Similar to first interval shifting tool 310*a*, second interval shifting tool 310*b* has a lower locking section 312*b* having an external diameter 316*b* the same or substantially the same as the diameter 302*b* of inner bore 252*b* of sliding sleeve 250*b*. Shifting tool 310*b* further includes a shifting key 314*b* which corresponds to shifting profile 254*b* of sleeve 250*b*. Shifting key 314*b* can selectively engage and lock with shifting profile 254*b* such that sleeve 250*b* can be axially translated by axial translation of second interval shifting tool 310*b*.

In the illustrated embodiment, outer diameter 320*b* of second shifting tool 310*b* is less than the diameter 302A of sliding sleeve 250*a*. As described in greater detail in reference to the following figures, second shifting tool 310*b* can in some embodiments be run axially through sliding sleeve 250*a* and central bore 222A of first interval ICD 130*a*, to engage with sliding sleeve 250*b* of second interval ICD 130*b* without engaging with sliding sleeve 250*a* of first interval ICD 130*a*. Likewise, additional ICDs deployed on production tubing string 112 can be configured with sliding sleeves having progressively smaller diameters to allow for the passage therethrough of shifting tools for the operation of ICDs progressively further downhole.

Figure 4A:
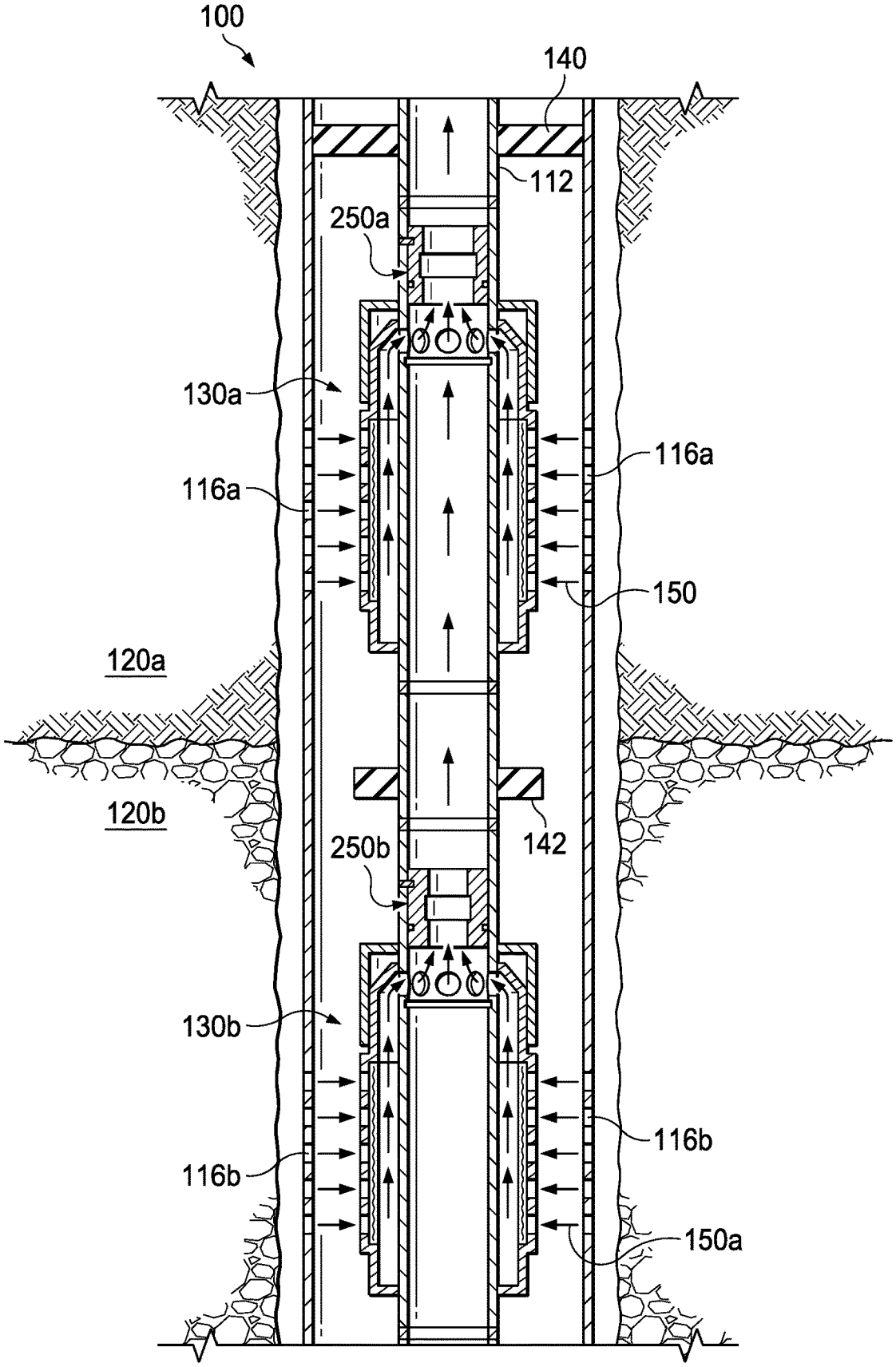
FIGS. 4A-4C are schematic illustrations of an operating sequence for selectively controlling flow from subterranean intervals into a production tubing string accordance with an embodiment of the present disclosure.
Figure 4B:
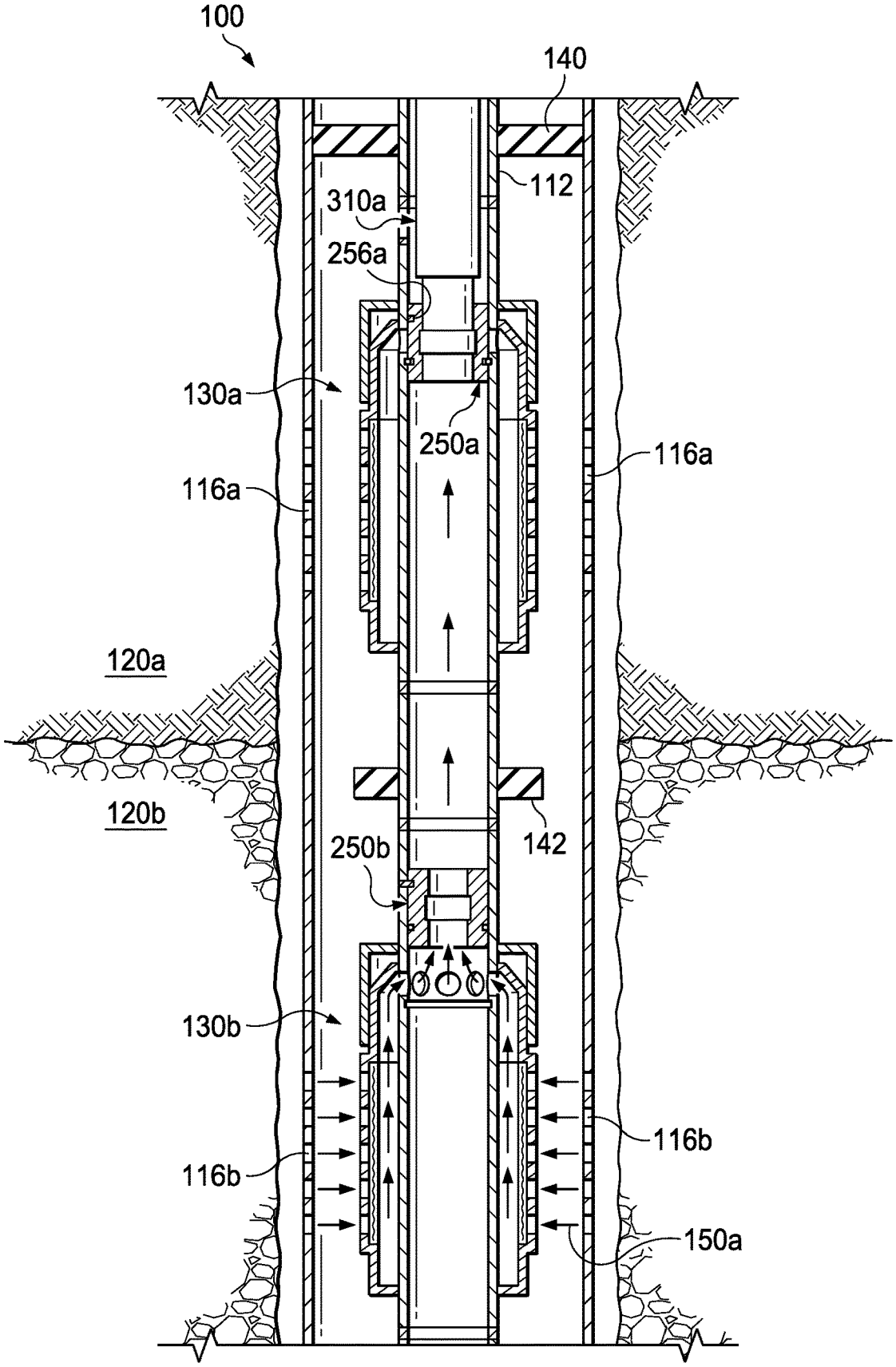
Figure 4C:
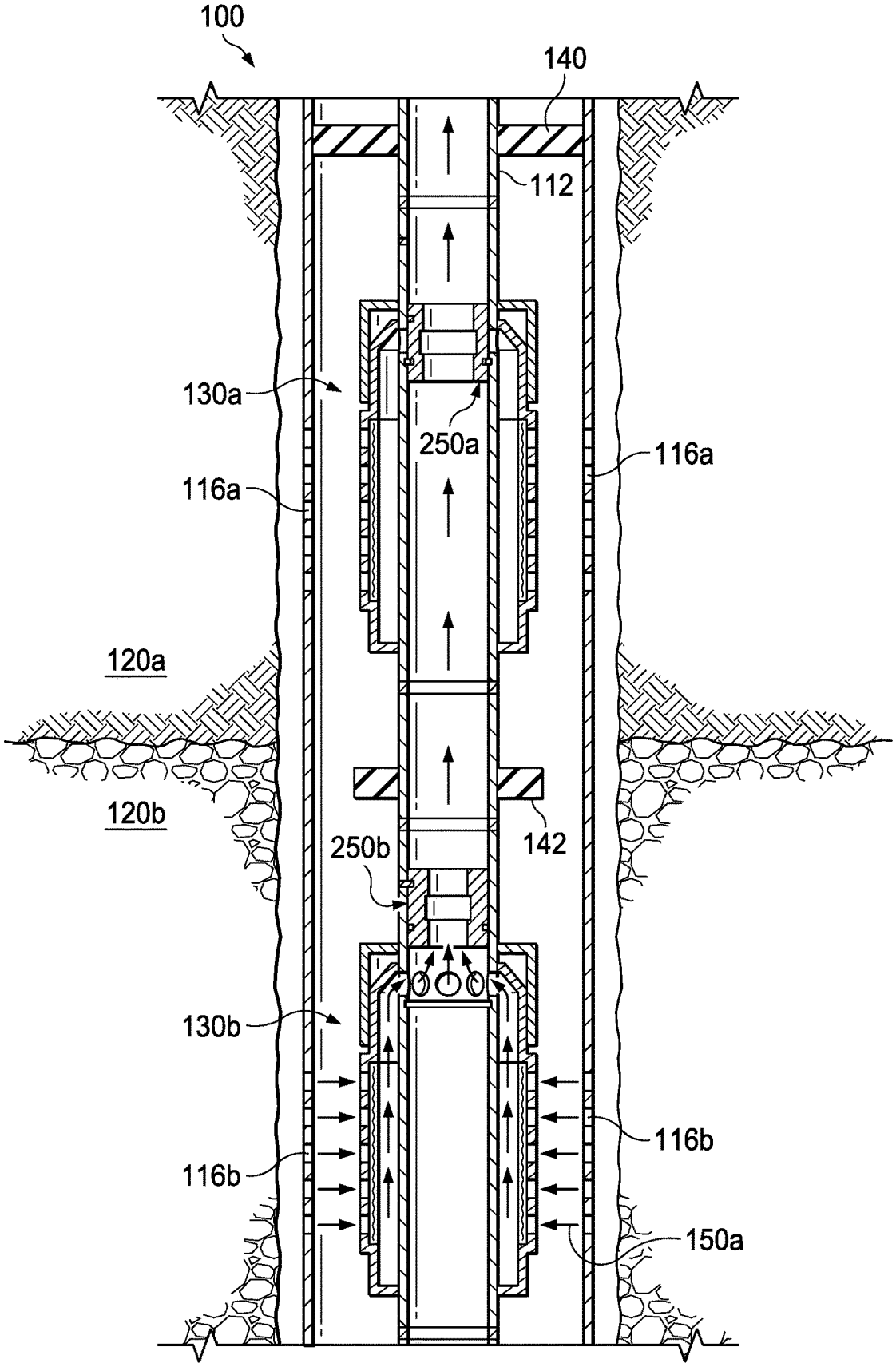

FIGS. 4A-4C are schematic illustrations of an operating sequence for selectively controlling flow from subterranean intervals into a production tubing string accordance with an embodiment of the present disclosure. In the sequence shown in FIGS. 4A-4C, production from the first interval (but not the second interval) is shut off. In the initial configuration shown in FIG. 4A, sliding sleeve 250*a* of first interval ICD 130*a* and sliding sleeve 250*b* are both in the first, open position, such that produced fluid 150*a* from first interval 120*a* and produced fluid 150*b* from second interval 120*b* can both flow into production tubing string 112 through first interval ICD 130*a* and second interval ICD 130*b*, respectively. Packer 140 is activated (expanded) to the set configuration so as to isolate the tubing-casing annulus uphole of perforations 116*a* and 116*b*. Lower packer 142 is in an initial, inactivated (unset) configuration.

If the operator desires to reduce or stop flow into production tubing string 112 from first interval 120*a* then, as shown in FIG. 4B, the operator can run first interval shifting tool 310*a* into first interval ICD 130*a* and lock shifting tool 310*a* into sliding sleeve 250*a*. By increasing the force applied to first interval shifting tool 310*a*, shear pin 256*a* can be sheared and sleeve 250*a* axially translated from the first (open) position to the second (closed) position, thereby blocking flow from first interval ICD 130*a* into production tubing 112. As shown in FIG. 4C, shifting tool 310*a* can then be removed from the wellbore, allowing flow from downhole of first interval ICD 130*a* (for example, from second interval 120*b* via perforations 116*b* through second interval ICD 130*b*) to continue. In some embodiments, not shown in FIGS. 4A-4C, subsequent to closing first interval ICD 130*a* or at another suitable time, lower packer 142 can be expanded (set) so as to seal and isolate that portion of the tubing-casing annulus below upper packer 140 and above packer 142 from that portion of the tubing-casing annulus below lower packer 142, thereby preventing or reducing inflow from interval 120*a* through second interval ICD 130*b*.

Figure 5A:
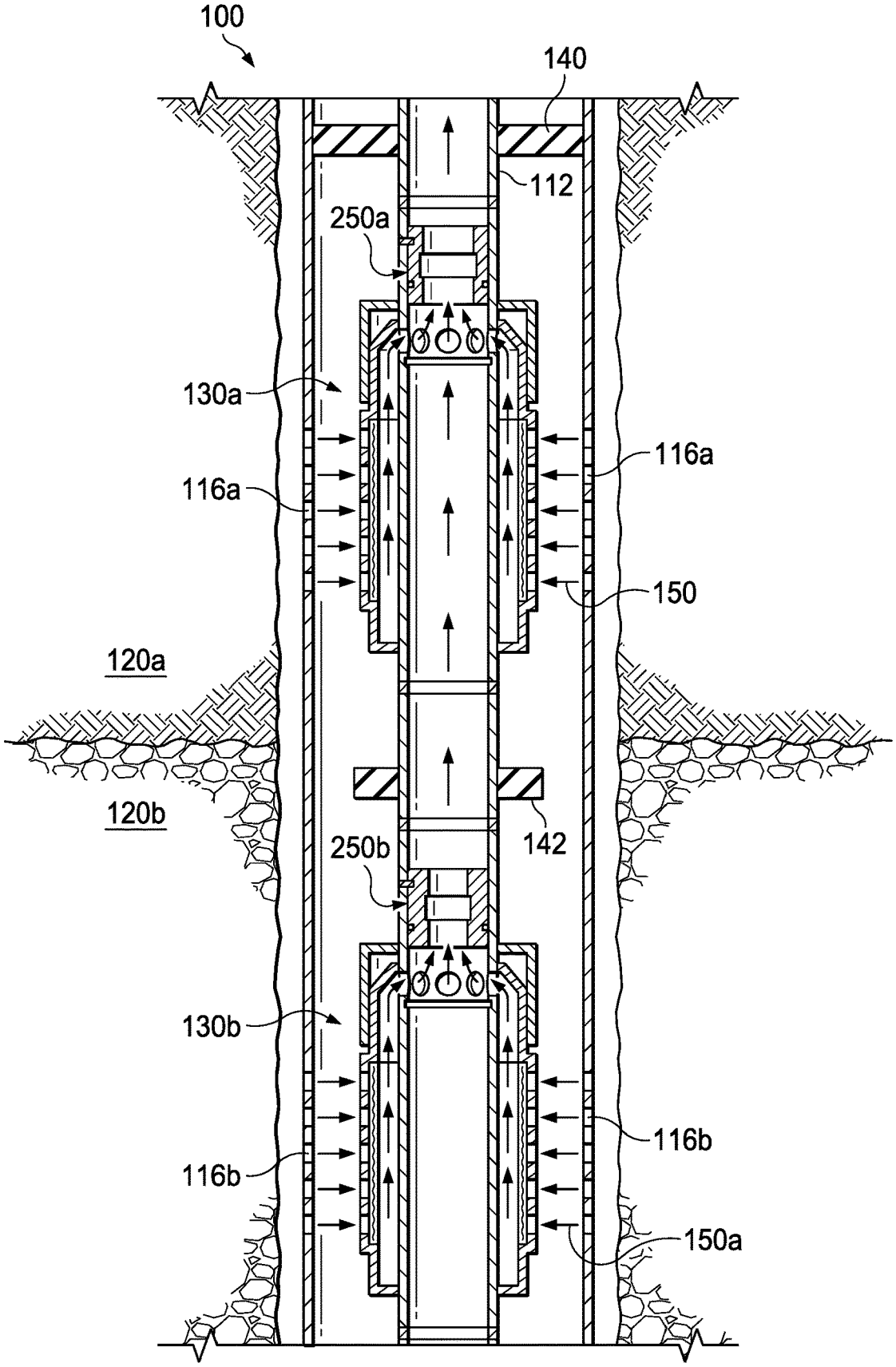
FIGS. 5A-5C are schematic illustrations of an alternative operating sequence for selectively controlling flow from subterranean intervals into a production tubing string in accordance with an embodiment of the present disclosure.
Figure 5B:
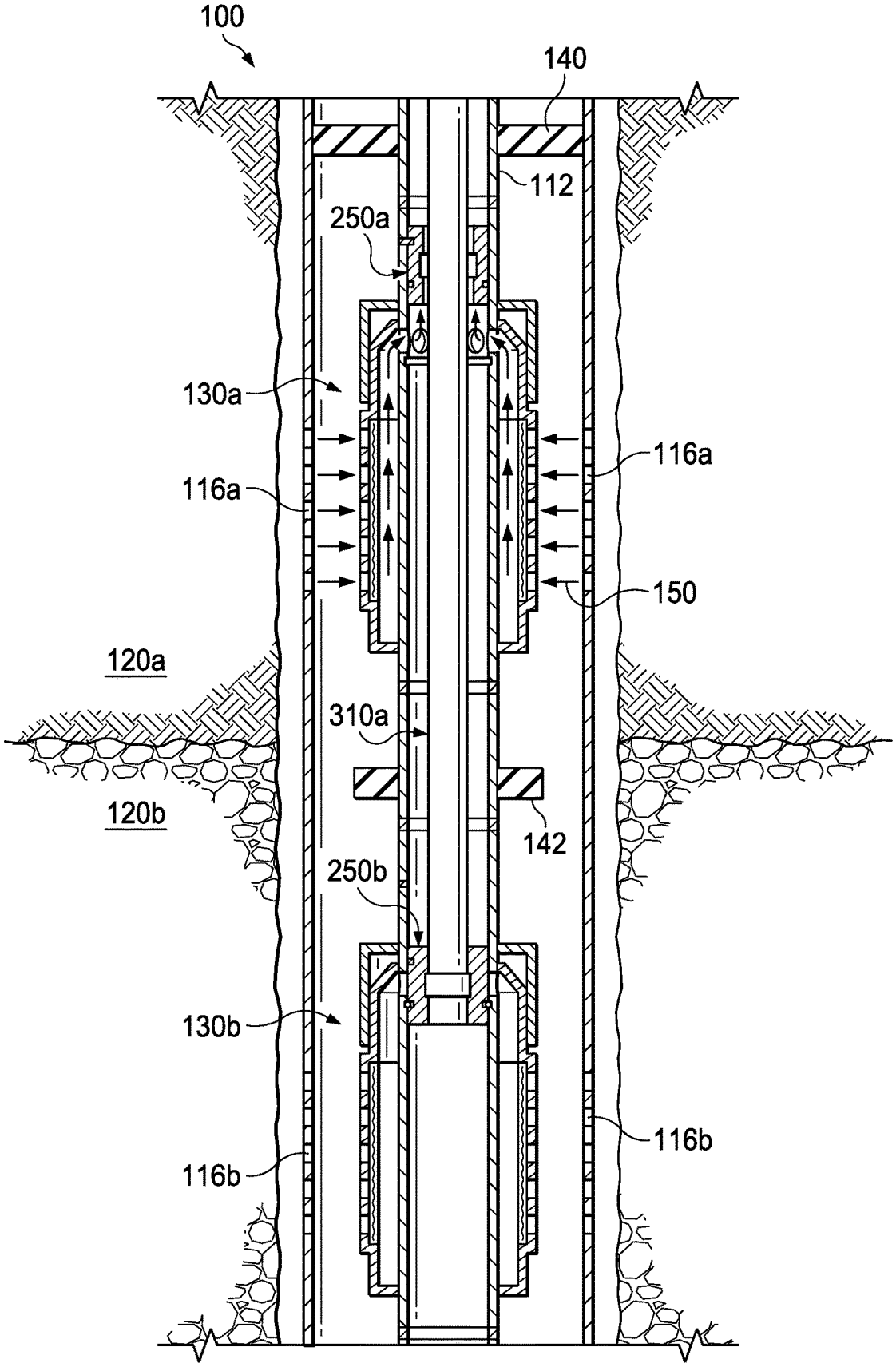
Figure 5C:
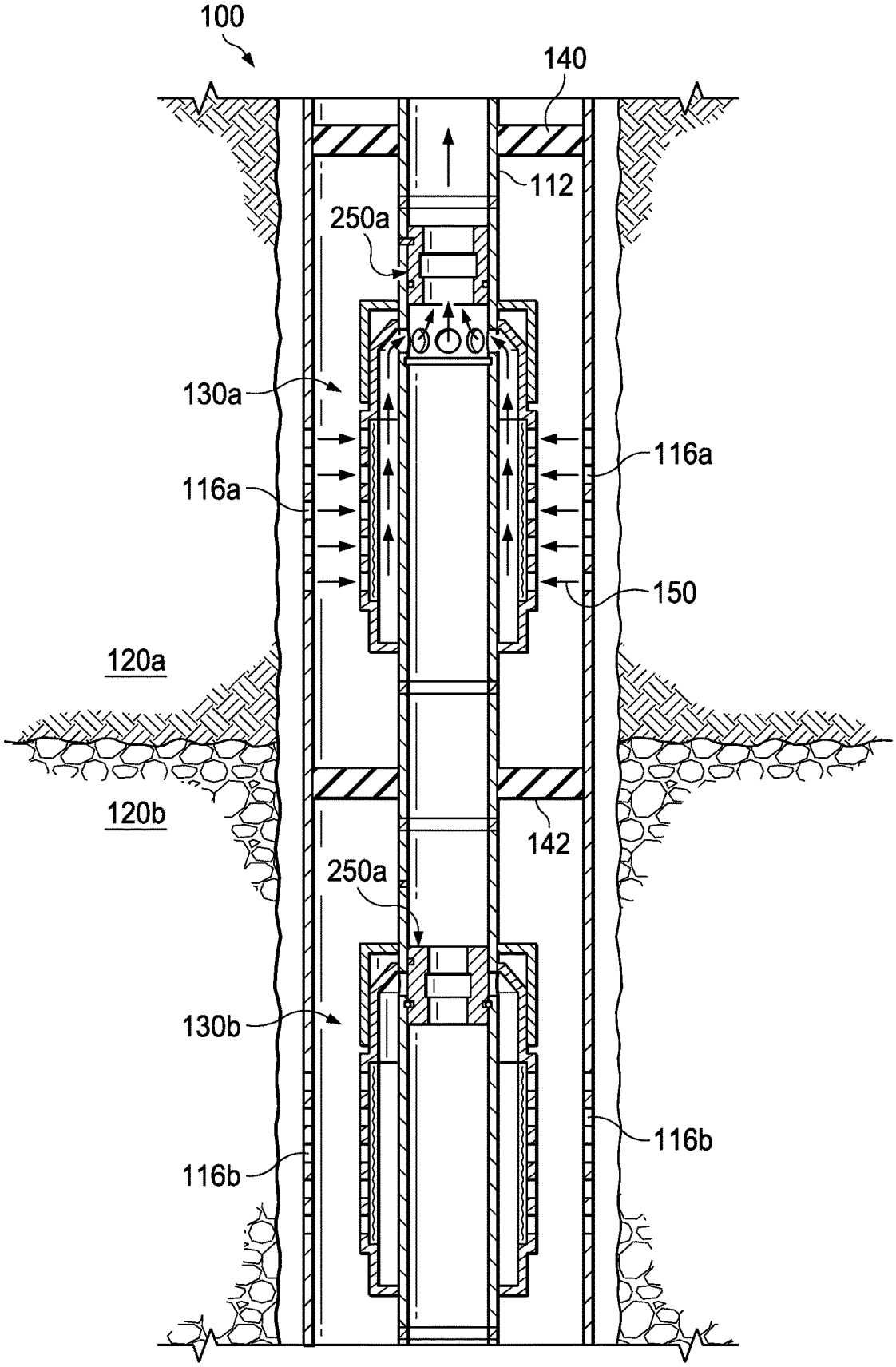

FIGS. 5A-5C are schematic illustrations of an alternative operating sequence for selectively controlling flow from subterranean intervals into a production tubing string in accordance with an embodiment of the present disclosure. In the sequence shown in FIGS. 5A-5C, production from the second interval (but not the first interval) is shut off. Similar to the sequence described in reference to FIGS. 4A-4C, in the initial configuration shown in FIG. 5A, sliding sleeve 250*a* of first interval ICD 130*a* and sliding sleeve 250*b* are both in the first, open position, such that produced fluid 150*a* from first interval 120*a* and produced fluid 150*b* from second interval 120*b* can both flow into production tubing string 112 through first interval ICD 130*a* and second interval ICD 130*b*, respectively. Packer 140 can be activated (expanded) to the set configuration so as to isolate the tubing-casing annulus uphole of perforations 116*a* and 116*b*. Lower packer 142 is in an initial, inactivated (unset) configuration.

If the operator desires to reduce or stop flow into production tubing string 112 from second interval 120*b* then, as shown in FIG. 5B, the operator can run shifting tool 310*b* through first interval ICD 130*a* and into second interval ICD 130*b* and lock shifting tool 310*b* into sliding sleeve 250*b*. By increasing the force applied to shifting tool 310*b*, shear pin 256*b* can be sheared and sleeve 250*b* axially translated from the first (open) position to the second (closed) position, thereby blocking flow from second interval ICD 130*b* into production tubing 112. As shown in FIG. 5C, lower packer 142 can be expanded (set) so as to seal and isolate that portion of the tubing-casing annulus below upper packer 140 and above packer 142 from that portion of the tubing-casing annulus below lower packer 142. Such packer configuration isolates the tubing-casing annulus that includes first interval ICD 130*a* and isolates first interval ICD 130*a* from second interval ICD 130*b*. Shifting tool 310*a* can then be removed from the wellbore, thus allowing flow from the first interval 120*a* via perforations 116*a* (through first interval ICD 130*a*) to continue.

Figure 6:
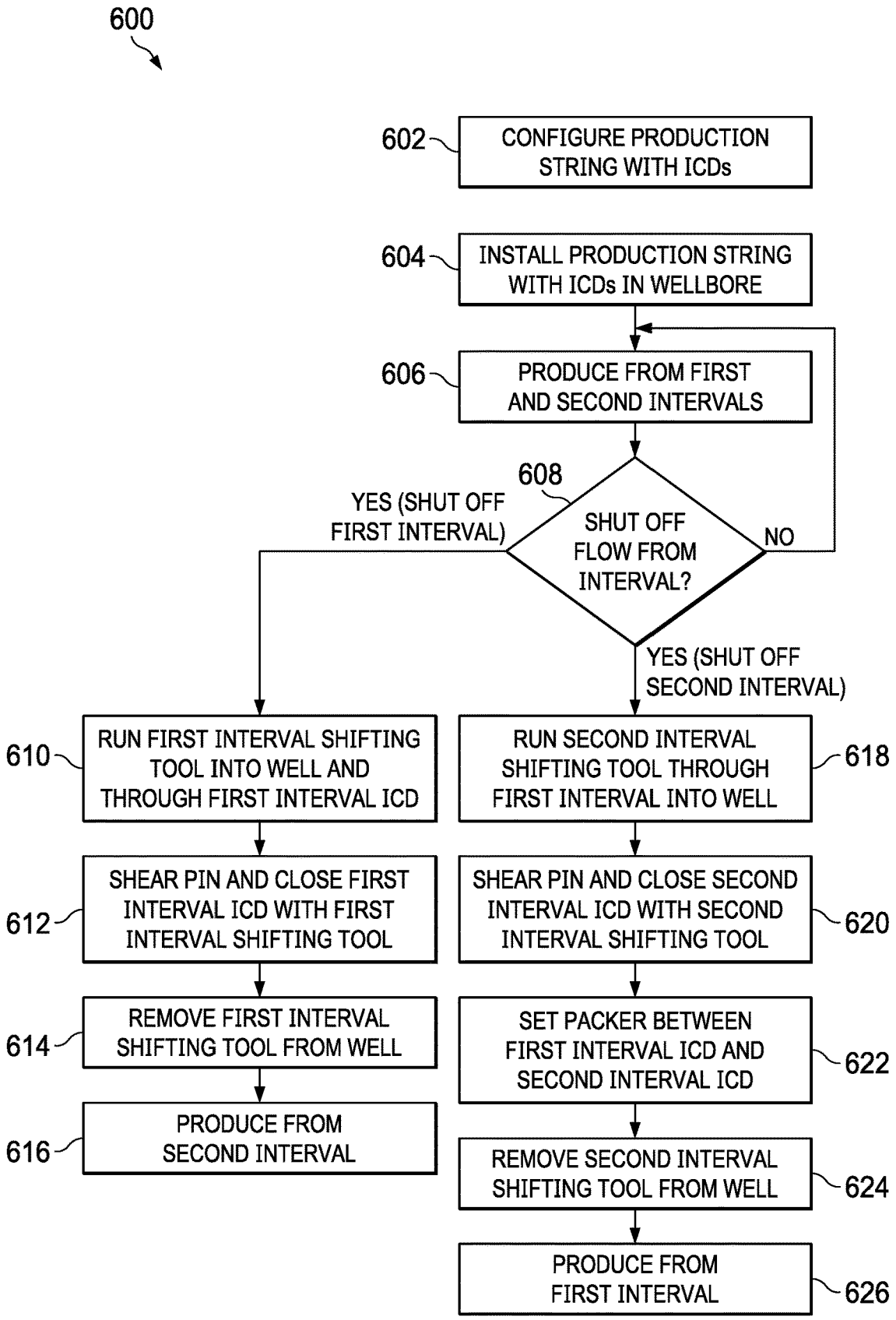
FIG. 6 is a process flow diagram of a method of selectively controlling flow from subterranean intervals into a production tubing string accordance with embodiments of the present disclosure.

FIG. 6 is a process flow diagram of a method of selectively controlling flow from subterranean zones into a production tubing string accordance with embodiments of the present disclosure. The method begins at step 602 in which a production tubing string having a first interval inflow control device and a second interval inflow control device is configured such that, if the production tubing string is positioned in a wellbore within a subterranean zone, the first interval inflow control device is proximate to a first set of perforations corresponding to a first subterranean interval (such as an oil or gas producing interval) of the subterranean zone and the second interval inflow control device is proximate to a second set of perforations corresponding to a second subterranean interval of the subterranean zone downhole of the first subterranean interval. In some embodiments, such as, for example an embodiment wherein a greater number of subterranean intervals are present or a greater number of interval ICDs are desired per interval, more than two interval ICDs can be installed on the production tubing string and accordingly configured. In some embodiments, the production tubing string further includes with one or more packers separating the interval ICDs. In an initial configuration, in some embodiments, only an upper packer uphole of the interval ICDs is set, isolating the annulus uphole of the ICDs from the annulus downhole of the ICDs, and each of the ICDs is in the open position, allowing inflow into the production tubing string from each of the intervals. Other packers below the upper packer and between the interval ICDs can be in the unset (unsealed) position. Proceeding to step 604, the production tubing string is installed in the wellbore.

Proceeding to step 606, hydrocarbons or other resources are produced from the first and second subterranean intervals (and, if applicable, the other intervals) through the production tubing string to the surface. Proceeding to step 608, the operator makes a determination of whether to shut off flow from a subterranean interval and, if so, which interval to shut off. Such determination can be in response to, for example, an indication that water from the interval has increased relative to the production of oil or gas from the interval. If at step 608 the operator determines that such shut off is not desired or necessary, then the method returns to step 606 in which the resources continue to be produced from all of the intervals.

If at step 608 the operator determines that shut-off of the first interval is desired, then the method proceeds to step 610 in which a first interval shifting tool (that is, a shifting tool sized and configured to latch into the sliding sleeve of the first interval ICD) is run into the well and locked into the sliding sleeve of the first interval ICD using a shifting and key mechanism or other suitable mechanism. At step 612, by increasing the force applied to first interval shifting tool, a shear pin holding the sliding sleeve in the first (open) position in sheared and the sleeve axially translated from the first (open) position to the second (closed) position. Proceeding to step 614, the first interval shifting tool is removed from the wellbore, and, at step 616, inflow into the production tubing string continues from the second interval ICD but inflow into the production tubing string from the first interval ICD is shut off by the sliding sleeve of the first interval ICD.

Returning to step 608, if the operator determines that shut-off of the second interval is desired, then the method proceeds to step 618 in which a second interval shifting tool (that is, a shifting tool sized and configured to freely pass through the first interval ICD and latch into the sliding sleeve of the second interval ICD downhole of the first interval ICD) is run into the well and locked into the sliding sleeve of the second interval ICD using a shifting and key mechanism or other suitable mechanism. At step 620, by increasing the force applied to second interval shifting tool, a shear pin holding the sliding sleeve in the first (open) position in sheared and the sleeve axially translated from the first (open) position to the second (closed) position. Proceeding to step 622, the packer between the first interval ICD and the second interval ICD is set (expanded) so as to seal and isolate that portion of the tubing-casing annulus below the second interval ICD from that portion of annulus above the second interval ICD and below the first interval. Proceeding to step 624, the second interval shifting tool is removed from the wellbore, and, at step 626, inflow into the production tubing string continues from the first interval ICD but inflow into the production tubing string from the second interval ICD is shut off by the sliding sleeve of the second interval ICD.

Shear pins 256*a* and 256*b* provide a simple and cost-effective mechanism for holding the sliding sleeves in the open position until translation of the sleeves to the closed position is desired. In some embodiments, instead of or in addition to shear pins (which once sheared are not resettable), a resettable latch systems (such as a spring-loaded lock and key mechanism) could be used, thereby enabling multiple or repeated translation and locking/unlocking cycles between the first and second positions.

The term "uphole" as used herein means in the direction along the production tubing or the wellbore from its distal end towards the surface, and "downhole" as used herein means the direction along the production tubing or the wellbore from the surface towards its distal end. A downhole location means a location along the production tubing or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system for selectively controlling flow from different subterranean intervals into a production tubing string positioned within a casing in a wellbore, the system comprising:

a first interval inflow control device configured to be positioned on the production tubing string proximate to a first set of perforations through the casing at a first subterranean interval;

a second interval inflow control device configured to be positioned on the production tubing string downhole of the first interval control device proximate to a second set of perforations through the casing at a second subterranean interval, wherein the first interval inflow control device and the second interval inflow control device each comprise:

a substantially cylindrical sand screen surrounding an inner tube, the inner tube having a central bore fluidically connected to and coaxial with a central bore of the production tubing string, wherein an annular space is formed between an inner surface of the sand screen and an outer surface of the inner tube, and wherein the annular space is fluidically connected to the central bore of the inner tube by a plurality of ports through the wall of the inner tube; and a sliding sleeve positioned within the inner bore and having a substantially cylindrical sleeve bore open to and coaxial with the central bore of the inner tube, the sliding sleeve configured to translate axially from a first, open position in which the sliding sleeve does not prevent a flow of fluid through the plurality of ports and a second, closed position in which the sliding sleeve prevents the flow of fluid through plurality of ports;

a first shifting tool configured to engage with and axially translate the sliding sleeve of the first interval inflow control device from the first, open position to the second, closed position; and a second shifting tool configured to engage with and axially translate the sliding sleeve of the second interval inflow control device from the first, open position to the second, closed position, wherein a minimum inner diameter of the sleeve bore of the sliding sleeve of the first interval control device is greater than a maximum inner diameter of the sleeve bore of the second interval control device and the first shifting tool has an outer diameter substantially the same as the minimum inner diameter of the sleeve bore of the sliding sleeve of the first interval control device.

2. The system of claim 1, further including a shear pin configured to releasably lock the sliding sleeve of the first interval inflow control device in the first, open position by a shear pin.

3. The system of claim 2, wherein the shear pin is configured to be sheared by an application of force by the first shifting tool to the sliding sleeve of the first interval inflow control device.

4. The system of claim 3, further comprising a locking ring configured to releasably lock the sliding sleeve of the first interval inflow control device in the second, closed position.

5. The system of claim 1, wherein the sliding sleeve of the second interval inflow control device is locked in the first, open position by a shear pin.

6. The system of claim 5, wherein the shear pin is configured to be sheared by an application of force by the second shifting tool to the sliding sleeve of the second interval inflow control device.

7. The system of claim 1, wherein the sliding sleeve of the first interval inflow control device further comprises a shifting profile configured to selectively engage with a corresponding shifting key of the first shifting tool.

8. The system of claim 1, wherein the sliding sleeve of the second interval inflow control device further comprises a shifting profile configured to selectively engage with a corresponding shifting key of the second shifting tool.

9. The system of claim 1, wherein a tubing-casing annulus is formed by an inner surface of the casing and an outer surface of the production tubing string, and further comprising:

a first packer positioned on the production tubing string uphole of the first interval inflow control device and configured to selectively isolate the tubing-casing annulus uphole of the first packer from the tubing-casing annulus downhole of the upper packer; and a second packer positioned on the production tubing string between the first interval inflow control device and the second interval inflow control device and configured to selectively isolate the tubing-casing annulus below the first packer and above the second packer from the tubing-casing annulus below the second packer.

10. The system of claim 1, wherein the second shifting tool is configured to pass through the first interval control device without engaging with the sliding sleeve of the first inflow control device.

11. The system of claim 1, wherein the system is configured prior to positioning the production tubing string in the wellbore such that, when the production tubing string is positioned in the wellbore, the first interval inflow control device is proximate to the first set of perforations and the second interval inflow control device is proximate to the second set of perforations.

12. A method for selectively controlling flow from different subterranean intervals into a production tubing string positioned within a casing in a wellbore, the method comprising:

lowering a first shifting tool in a downhole direction to a sliding sleeve of a first interval inflow control device positioned on the production tubing string proximate to a first set of perforations through the casing at a first subterranean interval;

engaging the first shifting tool with a sliding sleeve of the first interval inflow control device;

axially translating, by the first shifting tool, the sliding sleeve of the first interval inflow control device from a first, open position in which the sliding sleeve does not prevent a flow of fluid through the plurality of ports of the first interval inflow control device to a second, closed position in which the sliding sleeve prevents the flow of fluid through the plurality of ports of the first interval inflow control device;

passing a second shifting tool in a downhole direction through a sliding sleeve of the first interval inflow control device to engage with a sliding sleeve of a second interval inflow control device positioned on the production tubing string downhole of the first interval control device proximate to a second set of perforations through the casing at a second subterranean interval, wherein the first interval inflow control device and the second interval inflow control device each comprise a substantially cylindrical sand screen surrounding an inner tube, the inner tube having a central bore fluidically connected to and coaxial with a central bore of the production tubing string, wherein an annular space is formed between an inner surface of the sand screen and an outer surface of the inner tube, and wherein the annular space is fluidically connected to the central bore of the inner tube by a plurality of ports through the wall of the inner tube, and wherein the sliding sleeve of the first interval inflow control device and the sliding sleeve of the second interval inflow control device each have a substantially cylindrical sleeve bore open to and coaxial with the central bore of the respective inner tube, wherein a minimum inner diameter of the sleeve bore of the sliding sleeve of the first interval control device is greater than a maximum inner diameter of the sleeve bore of the second interval control device and the first shifting tool has an outer diameter substantially the same as the minimum inner diameter of the sleeve bore of the sliding sleeve of the first interval control device;

engaging the second shifting tool with the sliding sleeve of the second interval inflow control device; and axially translating, by the second shifting tool, the sliding sleeve of the second interval inflow control device from a first, open position in which the sliding sleeve does not prevent a flow of fluid through the plurality of ports of the second interval inflow control device to a second, closed position in which the sliding sleeve prevents the flow of fluid through the plurality of ports of the second interval inflow control device.

13. The method of claim 12, wherein engaging the second shifting tool with the sliding sleeve of the second interval inflow control device comprises engaging a shifting key of the second shifting tool with a shifting profile of the sliding sleeve of the second inflow control device.

14. The method of claim 12, further comprising shearing, by an application of force to the second shifting tool, a shear pin locking the sliding sleeve of the second interval inflow control device in the first, open position by a shear pin.

15. The method of claim 14, wherein axially translating the sliding sleeve of the first interval inflow control device from the first, open position to the second, closed position comprises engaging the first interval control device into a locking ring configured to releasably lock the sliding sleeve of the first interval inflow control device in the second, closed position.

16. The method of claim 12, wherein a tubing-casing annulus is formed by an inner surface of the casing and an outer surface of the production tubing string and wherein a first packer positioned on the production tubing string uphole of the first interval inflow control device isolates the tubing-casing annulus uphole of the first packer from the tubing-casing annulus downhole of the upper packer, and further comprising actuating a second packer positioned on the production tubing string between the first interval inflow control device and the second interval inflow control device and thereby isolating the tubing-casing annulus below the first packer and above the second packer from the tubing-casing annulus below the second packer.

17. The method of claim 12, wherein engaging the first shifting tool with the sliding sleeve of the first interval inflow control device comprises engaging a shifting key of the first shifting tool with a shifting profile of the sliding sleeve of the first inflow control device.

18. The method of claim 12, wherein a tubing-casing annulus is formed by an inner surface of the casing and an outer surface of the production tubing string and wherein a first packer positioned on the production tubing string uphole of the first interval inflow control device isolates the tubing-casing annulus uphole of the first packer from the tubing-casing annulus downhole of the upper packer, and further comprising actuating a second packer positioned on the production tubing string between the first interval inflow control device and the second interval inflow control device and thereby isolating the tubing-casing annulus below the first packer and above the second packer from the tubing-casing annulus below the second packer.

19. The method of claim 12, wherein the second shifting tool is configured to pass through the first interval control device without engaging with the sliding sleeve of the first inflow control device.

20. The method of claim 12, further comprising, prior to positioning the production tubing string in the wellbore, configuring the production tubing string such that, when the production tubing string is positioned in the wellbore, the first interval inflow control device is proximate to the first set of perforations and the second interval inflow control device is proximate to the second set of perforations.

21. The method of claim 12, wherein actuating the sliding sleeve is in response to an indication that an amount of water relative to an amount of oil or gas produced from the second subterranean interval has increased.

* * * * *